US005531910A

United States Patent [19]

Severns et al.

[11] Patent Number: 5,531,910

[45] Date of Patent: Jul. 2, 1996

[54] BIODEGRADABLE FABRIC SOFTENER COMPOSITIONS WITH IMPROVED PERFUME LONGEVITY

[75] Inventors: John C. Severns, West Chester; Mark R. Sivik, Fairfield; Frederick A. Hartman, Cincinnati, all of Ohio; Hugo R. G. Denutte, Hofstade, Belgium; Jill B. Costa, Cincinnati; Alex H. Chung, West Chester, both of Ohio

[73] Assignee: The Procter & Gamble Company, Cincinnati, Ohio

[21] Appl. No.: 499,282

[22] Filed: Jul. 7, 1995

[51] Int. Cl.[6] ..... D06M 13/224; D06M 13/46

[52] U.S. Cl. ..... 510/102; 512/18; 512/26; 560/190; 560/205; 560/221; 560/76; 560/95; 510/105; 510/106; 510/107; 510/521; 510/522; 510/524

[58] Field of Search ..... 252/8.8, 8.9, 8.6, 252/174.11; 512/18, 26; 560/190, 205, 221, 76, 95

[56] References Cited

U.S. PATENT DOCUMENTS

| | | | |
|---|---|---|---|
| 2,847,383 | 8/1958 | Spencer et al. | 252/42.7 |
| 3,077,457 | 2/1963 | Kulka | 252/305 |
| 4,524,021 | 6/1985 | Wiegers et al. | 252/522 R |
| 4,668,433 | 5/1987 | Ochsner | 252/522 R |
| 4,677,223 | 6/1987 | Pittet et al. | 560/147 |
| 4,714,565 | 12/1987 | Wevers et al. | 252/174.19 |
| 5,081,111 | 1/1992 | Akimoto et al. | 525/285 |
| 5,298,569 | 3/1994 | Yamamori et al. | 525/329.5 |
| 5,320,837 | 1/1994 | Akimoto et al. | 424/78.19 |
| 5,336,767 | 8/1994 | della Valle et al. | 536/55.1 |
| 5,378,468 | 1/1995 | Suffis et al. | 424/401 |
| 5,445,747 | 8/1995 | Kvietok et al. | 252/8.6 |
| 5,474,691 | 12/1995 | Severns | 252/8.9 |

FOREIGN PATENT DOCUMENTS

| | | | |
|---|---|---|---|
| 228671 | 7/1958 | Australia . | |
| 304073 | 12/1988 | Japan . | |
| 3-17025 | 1/1991 | Japan | A61K 47/48 |
| 588 | 8/1979 | WIPO . | |

OTHER PUBLICATIONS

McGee, H. L. Some Physical Properties of Long Chained Esters of Dibasic Acids, Jan. 1962, vol. 7 No. 1 Journal of Chemical and Engineering Data pp. 102–106.

*Primary Examiner*—Paul Lieberman
*Assistant Examiner*—Michael P. Tierney
*Attorney, Agent, or Firm*—Thomas G. Krivulka

[57] ABSTRACT

The present invention relates to liquid and solid biodegradable fabric softener compositions combined with nonionic or anionic esters of a non-allylic alcohol perfumes. These compositions exhibit improved perfume longevity and reduced enviromental impact.

16 Claims, No Drawings

BIODEGRADABLE FABRIC SOFTENER COMPOSITIONS WITH IMPROVED PERFUME LONGEVITY

FIELD OF THE INVENTION

The present invention relates to liquid and rinse-added granular, biodegradable fabric softener compositions combined with nonionic or anionic esters of non-allylic perfume alcohols.

BACKGROUND OF THE INVENTION

Consumer acceptance of laundry products is determined not only by the performance achieved with these products but the aesthetics associated therewith. The perfume systems are therefore an important aspect of the successful formulation of such commercial products.

What perfume system to use for a given product is a matter of careful consideration by skilled perfumers. While a wide array of chemicals and ingredients are available to perfumers, considerations such as availability, cost, and compatibility with other components in the compositions limit the practical options. Thus, there continues to be a need for low-cost, compatible perfume materials useful for laundry compositions.

In the rinse cycle of the laundry process, a substantial amount of perfume in the fabric softener composition can be lost when the rinse water is spun out (in a washing machine), or wrung out (during hand washing), even if the perfume is encapsulated or included in a carrier.

Furthermore, due to the high energy input and large air flow in the drying process used in the typical automatic laundry dryers, a large part of most perfumes provided by fabric softener products is lost from the dryer vent. Perfume can be lost even when the fabrics are line dried. Concurrent with effort to reduce the environmental impact of fabric softener compositions, it is desirable to formulate efficient, enduring fabric softener perfume compositions that remain on fabric for aesthetic benefit, and are not lost, or wasted, without benefiting the laundered items.

The present invention provides improved compositions with less environmental impact due to using a combination of biodegradable softener and efficient perfumes in rinse-added fabric softening compositions while, surprisingly, also providing improved longevity of perfumes on the laundered clothes, by utilizing enduring perfume compositions.

It has been discovered that esters of certain nonionic and anionic non-allylic perfume alcohols are particularly well suited for fabric softening compositions. In particular, it has been discovered that depending on the acid group utilized and/or fabric softening compositions into which these are incorporated, esters of non-allylic perfume alcohols will gradually hydrolyze to release the non-allylic alcohol perfume. In addition, slowly hydrolyzable esters of non-allylic perfume alcohols provide release of the perfume over a longer period of time than by the use of the perfume itself in the biodegradable fabric softening compositions. Such materials therefore provide perfumers with more options for perfume ingredients and more flexibility in formulation considerations. These and other advantages of the present invention will be seen from the disclosures hereinafter.

BACKGROUND ART

General ester chemistry is described in Carey et al., Advanced Organic Chemistry, Part A, 2nd Ed., pp. 421–426 (Plenum, N.Y.; 1984); and March, Advanced Organic Chemistry, 3rd Ed., pp. 346–354 (Wiley, N.Y., 1985).

Compositions of fragrance materials (having certain values for Odour Intensity Index, Malodour Reduction Value and Odour Reduction Value) said to be used as fragrance compositions in detergent compositions and fabric conditioning compositions are described in European Patent Application Publication No. 404,470, published Dec. 27, 1990 by Unilever PLC. Example 1 describes a fabric-washing composition containing 0.2% by weight of a fragrance composition which itself contains 4.0% geranyl phenylacetate. A process for scenting fabrics washed with lipase-containing detergents is described in PCT application No. WO 95/04809, published Feb. 16, 1995 by Firmenich S. A.

SUMMARY OF THE INVENTION

The present invention relates to rinse-added fabric softening compositions selected from the group consisting of:

I. a solid particulate composition comprising:

(A) from about 50% to about 95% of biodegradable cationic, preferably diester, quaternary ammonium fabric softening compound, preferably from about 60% to about 90%, of said softening compound;

(B) from about 0.01% to about 15%, by weight of the composition, of nonionic or anionic compound that is an ester of non-allylic alcohol, wherein said non-allylic alcohol forming said ester is a perfume with a boiling point at 760 mm Hg of less than about 300° C., wherein $H—O—CR'_2—CR''_2—CR'''_3$ is said non-allylic alcohol, said ester having the formula:

$$R—(\overset{\overset{\displaystyle O}{\|}}{C}—O—CR'_2—CR''_2—CR'''_3)_n$$

wherein R, R', R'', and R''' are as described hereinafter, and n is an integer of 1 or greater;

(C) optionally, from 0% to about 30% of dispersibility modifier; and (D) optionally, from 0% to about 10% of a pH modifier; and II. a liquid composition comprising:

(A) from about 0.5% to about 80% of biodegradable cationic, preferably diester, quaternary ammonium fabric softening compound, preferably from about 1% to about 35%, and more preferably from about 4% to about 32%, of said biodegradable softening compound;

(B) from about 0.01% to about 10%, by weight of the composition, of nonionic or anionic compound that is an ester of non-allylic alcohol, wherein said non-allylic alcohol forming said ester is a perfume with a boiling point at 760 mm Hg of less than about 300° C., wherein $H—O—CR'_2—CR'''_2—CR'''_3$ is said non-allylic alcohol, said ester having the formula:

$$R—(\overset{\overset{\displaystyle O}{\|}}{C}—O—CR'_2—CR''_2—CR'''_3)_n$$

wherein R, R', R'', and R''' are as described hereinafter, and n is an integer of 1 or greater; and (C) optionally, from 0% to about 30% of dispersibility modifier wherein the dispersibility modifier affects the composition's viscosity, dispersibility in a laundry process rinse cycle, or both; and (D) the balance comprising a liquid carrier selected from the group consisting of water, $C_1$–$C_4$ monohydric alcohols, $C_2$–$C_6$ polyhydric alcohols, liquid polyalkylene glycols, and mixtures thereof.

R is selected from the group consisting of $C_1$–$C_{30}$, preferably $C_1$–$C_{20}$, straight, branched or cyclic alkyl, alkenyl, alkynyl, alkyl-aryl, or aryl group, excluding $CH_3$— and $CH_3CH_2$—, and represents the group attached to the carboxylate function of the moiety reacted with the perfume alcohol used to make the perfume ester. R is selected to give the perfume ester its desired chemical and physical properties such as: 1) chemical stability in the product matrix, 2) formulatability into the product matrix, 3) desirable rate of perfume release, etc. The product(s) and rate of hydrolysis of the non-allylic alcohol ester can be controlled by the selection of R. Esters having more than one carboxylate group per molecule (e.g., diesters; triesters) are also included within the scope of the present invention, and are preferred.

Each R' is independently selected from the group consisting of hydrogen, or a $C_1$–$C_{25}$ straight, branched or cyclic alkyl, alkenyl, alkynyl, alkyl-aryl, or aryl group. The two R' moieties can be the same or different. Preferably at least one R' is hydrogen.

Each R" is independently selected from the group consisting of hydrogen, or a $C_1$–$C_{25}$ straight, branched or cyclic alkyl, alkenyl, alkynyl, alkyl-aryl, or aryl group. The two R" moieties can be the same or different.

Each R"' is independently selected from the group consisting of hydrogen, or a $C_1$–$C_{25}$ straight, branched or cyclic alkyl, alkenyl, alkynyl, alkyl-aryl, or aryl group. The R"' can be the same or different. Preferably, one R"' is hydrogen or a straight, branched or cyclic $C_1$–$C_{20}$ alkyl or alkenyl groups. More preferably, one R"' is hydrogen, methyl, ethyl, or alkenyl and another R"' is a straight, branched or cyclic $C_1$–$C_{20}$ alkyl, alkenyl or alkyl-aryl group.

In addition, each of the above R, R', R", and R"' moieties can be unsubstituted or substituted with one or more nonionic and/or anionic substituents. Such substituents can include, for example, halogens, nitro, carboxy, carbonyl, sulfate, sulfonate, hydroxy, and alkoxy, and mixtures thereof.

The preferred compositions comprise the esters of the following perfume alcohols:

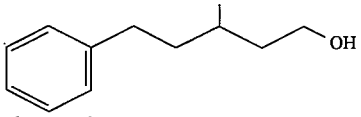

phenoxanol;

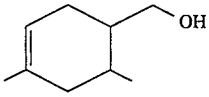

floralol;

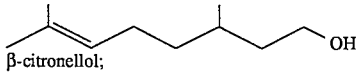

β-citronellol;

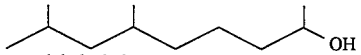

nonadyl alcohol;

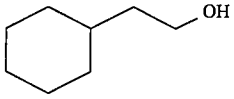

-continued cyclohexyl ethanol;

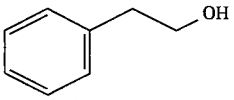

phenyl ethanol;

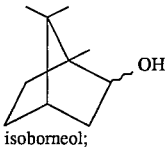

isoborneol;

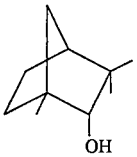

fenchol;

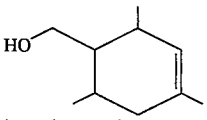

isocyclogeranol;

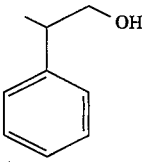

2-phenol-1-propanol

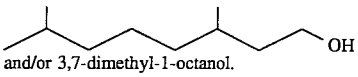

and/or 3,7-dimethyl-1-octanol.

and/or 3,7-dimethyl-1-octanol.

Most preferred esters for use herein are:

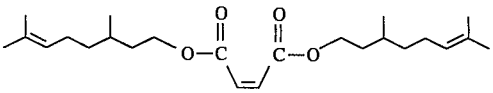

referred to herein as "di-β-citronellyl maleate" and

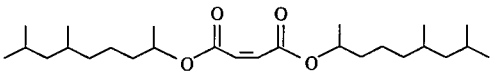

referred to herein as "dinonadyl maleate" and

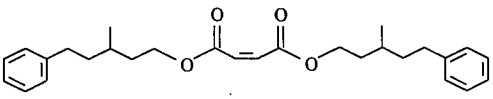

referred to herein as "diphenoxanyl maleate"; and

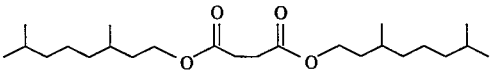

referred to herein as "di(3,7-dimethyl-1-octanyl) succinate"; and

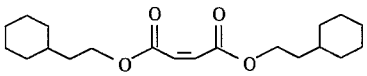

referred to herein as "di(cyclohexylethyl) maleate"; and

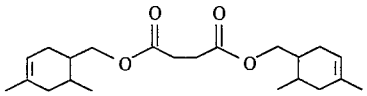

referred to herein as "difloralyl succinate"; and

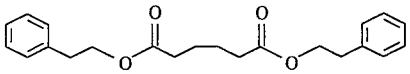

referred to herein as "di(phenylethyl)adipate".

A particularly preferred liquid composition comprises:

(A) from about 15% to about 50% of biodegradable quaternary ammonium fabric softening compound;

(B) from about 0.01% to about 10%, by weight of the composition, of nonionic or anionic compound that is an ester of non-allylic alcohol, wherein said non-allylic alcohol forming said ester is a perfume with a boiling point at 760 mm Hg of less than about 300° C., wherein H—O—$CR'_2$—$CR''_2$—$CR'''_3$ is said non-allylic alcohol, said ester having the formula:

$$R-(\overset{O}{\overset{\|}{C}}-O-CR'_2-CR''_2-CR'''_3)_n$$

wherein R, R', R'', and R''' are as described hereinbefore, and n is an integer of 1 or greater;

(C) optionally, from 0% to about 5% of dispersibility modifier selected from the group consisting of:

1. single-long-chain-$C_{10}$–$C_{22}$ alkyl, cationic surfactant;
2. nonionic surfactant with at least 8 ethoxy moieties; and
3. mixtures thereof;

(D) optionally, from 0% to about 1% of a stabilizer;

(E) from about 0.01% to about 2% electrolyte; and (F) the balance comprising a liquid carrier selected from the group consisting of water, $C_1$–$C_4$ monohydric alcohols, $C_2$–$C_6$ polyhydric alcohols, liquid polyalkylene glycols, and mixtures thereof.

The present invention also relates to novel nonionic or anionic compounds that are esters of non-allylic alcohols, wherein said non-allylic alcohol forming said ester is a perfume with a boiling point at 760 mm Hg of less than about 300° C., wherein H—O—$CR'_2$—$CR''_2$—$CR'''_3$ is said non-allylic alcohol, said ester having the formula:

$$R-(\overset{O}{\overset{\|}{C}}-O-CR'_2-CR''_2-CR'''_3)_n$$

(a) wherein n is 2 and R is selected from the group consisting of $C_1$–$C_{30}$ branched alkyl, or $C_3$–$C_{30}$ straight, branched or cyclic alkenyl, alkynyl, alkyl-aryl, or aryl groups; wherein R', R'', and R''' are as described hereinbefore; and (b) wherein n is 3 or greater and R is selected from the group consisting of $C_1$–$C_{30}$, preferably $C_1$–$C_{20}$, straight, branched or cyclic alkyl, alkenyl, alkynyl, alkyl-aryl, or aryl groups; wherein R', R'', and R''' are as described hereinbefore.

Examples of (a) include, but are not limited to, di-β-citronellyl phthalate and diphenethyl phthalate.

Examples of (b) include, but are not limited to, tetra-β-citronellyl pyromellitate and tetracyclohexyl pyromellitate.

All percentages, ratios and proportions herein are by weight, unless otherwise specified. All documents cited are, in relevant part, incorporated herein by reference.

DETAILED DESCRIPTION OF THE INVENTION

The present invention relates to rinse-added fabric softening compositions selected from the group consisting of:

I. a solid particulate composition comprising:

(A) from about 50% to about 95% of biodegradable cationic, preferably diester, quaternary ammonium fabric softening compound, preferably from about 60% to about 90%, of said softening compound;

(B) from about 0.01% to about 15%, by weight of the composition, of nonionic or anionic compound that is an ester of non-allylic alcohol, wherein said non-allylic alcohol forming said ester is a perfume with a boiling point at 760 mm Hg of less than about 300° C., wherein H—O—$CR'_2$—$CR''_2$—$CR'''_3$ is said non-allylic alcohol, said ester having the formula:

$$R-(\overset{O}{\overset{\|}{C}}-O-CR'_2-CR''_2-CR'''_3)_n$$

wherein R, R', R'', and R''' are as described hereinbefore, and n is an integer of 1 or greater;

(C) optionally, from 0% to about 30% of dispersibility modifier; and (D) optionally, from 0% to about 10% of a pH modifier; and II. a liquid composition comprising:

(A) from about 0.5% to about 80% of biodegradable cationic, preferably diester, quaternary ammonium fabric softening compound, preferably from about 1% to about 35%, and more preferably from about 4% to about 32%, of said biodegradable softening compound;

(B) from about 0.01% to about 10%, by weight of the composition, of nonionic or anionic compound that is an ester of non-allylic alcohol, wherein said non-allylic alcohol forming said ester is a perfume with a boiling point at 760 mm Hg of less than about 300° C., wherein H—O—$CR'_2$—$CR''_2$—$CR'''_3$ is said non-allylic alcohol, said ester having the formula:

$$R-(\overset{O}{\overset{\|}{C}}-O-CR'_2-CR''_2-CR'''_3)_n$$

wherein R, R', R'', and R''' are as described hereinbefore, and n is an integer of 1 or greater; and (C) optionally, from 0% to about 30% of dispersibility modifier wherein the dispersibility modifier affects the composition's viscosity, dispersibility in a laundry process rinse cycle, or both; and (D) the balance comprising a liquid carrier selected from the group consisting of water, $C_1$–$C_4$ monohydric alcohols, $C_2$–$C_6$ polyhydric alcohols, liquid polyalkylene glycols, and mixtures thereof.

A particularly preferred liquid composition comprises:

(A) from about 15% to about 50% of biodegradable diester quaternary ammonium fabric softening compound;

(B) from about 0.01% to about 10%, by weight of the composition, of nonionic or anionic compound that is an ester of non-allylic alcohol, wherein said non-allylic alcohol forming said ester is a perfume with a boiling point at 760 mm Hg of less than about 300° C., wherein H—O—CR'$_2$—CR"$_2$—CR"'$_3$ is said non-allylic alcohol, said ester having the formula:

$$R-(C(=O)-O-CR'_2-CR''_2-CR'''_3)_n$$

wherein R, R', R", and R"' are as described hereinbefore, and n is an integer of 1 or greater;

(C) optionally, from 0% to about 5% of dispersibility modifier selected from the group consisting of:
1. single-long-chain-$C_{10}$–$C_{22}$ alkyl, cationic surfactant;
2. nonionic surfactant with at least 8 ethoxy moieties;
3. amine oxide surfactant; or
4. mixtures thereof (D) optionally, from 0% to about 1% of a stabilizer;

(E) from about 0.01% to about 2% electrolyte; and (F) the balance comprising a liquid carrier selected from the group consisting of water, $C_1$–$C_4$ monohydric alcohols, $C_2$–$C_6$ polyhydric alcohols, liquid polyalkylene glycols, and mixtures thereof.

Water can be added to the particulate solid granular compositions to form dilute or concentrated liquid softener compositions with a concentration of said biodegradable quaternary ammonium fabric softening compound of from about 0.5% to about 50%, preferably from about 1% to about 35%, more preferably from about to about 32%. The liquid and granular biodegradable fabric softener compositions can be added directly in the rinse both to provide adequate usage concentration, e.g., from about 10 to about 2,500 ppm, preferably from about 30 to about 2000 ppm, of the biodegradable, cationic fabric softener compound, or water can be pre-added to the particulate, solid, granular composition to form dilute or concentrated liquid softener compositions that can be added to the rinse to provide the same usage concentration.

(A) Biodegradable Quaternary Ammonium Fabric Softening Compounds

The compounds of the present invention are biodegradable quaternary ammonium compounds, preferably diester compounds, wherein, preferably, the fatty acyl groups have an Iodine Value (IV) of from greater than about 5 to less than about 100, and, also preferably, a cis/trans isomer weight ratio of greater than about 30/70 when the IV is less than about 25, the level of unsaturation preferably being less than about 65% by weight. Preferably, said compounds with an IV of greater than about 10 are capable of forming concentrated aqueous compositions with concentrations greater than about 13% by weight without viscosity modifiers other than normal polar organic solvents present in the raw material of the compound or added electrolyte, and wherein any fatty acyl groups from tallow are preferably modified, especially to reduce their odor.

The present invention relates to fabric softening compositions comprising biodegradable quaternary ammonium compounds, preferably diester compounds (DEQA), preferably having the formula:

$$(R)_{4-m}-N^+-((CH_2)_n-Y-R^1)_mX^- \quad (I)$$

wherein: each Y=—O—(O)C—, or —C(O)—O—; m=2 or 3; each n=1 to 4; each R substituent is a short chain $C_1$–$C_6$, preferably $C_1$–$C_3$, alkyl group, e.g., methyl (most preferred), ethyl, propyl, and the like, benzyl, $C_1$–$C_6$, preferably $C_1$–$C_3$, hydroxy alkyl group, e.g., 2-hydroxy ethyl, 2-hydroxy propyl, 3-hydroxy propyl, and the like, or mixtures thereof, each $R^1$ is $C_{11}$–$C_{22}$ hydrocarbyl, or substituted hydrocarbyl substituent, $R^1$ is preferably partially unsaturated (with Iodine Value (IV) of greater than about 5 to less than about 100), and the counterion, $X^-$, can be any suitable softener-compatible anion, for example, chloride, bromide, methylsulfate, formate, sulfate, nitrate and the like;

Any reference to IV values hereinafter refers to the Iodine Value of fatty acyl groups and not to the resulting softener compound.

When the IV of the fatty acyl groups is above about 20, the softener provides excellent antistatic effect. Antistatic effects are especially important where the fabrics are dried in a tumble dryer, and/or where synthetic materials which generate static are used. Maximum static control occurs with an IV of greater than about 20, preferably greater than about 40. When fully saturated softener compounds are used in the compositions, poor static control results. Also, as discussed hereinafter, concentratability increases as IV increases. The benefits of concentratability include: use of less packaging material; use of less organic solvents, especially volatile organic solvents; use of less concentration aids which typically add nothing to performance; etc.

As the IV is raised, there is a potential for odor problems. Surprisingly, some highly desirable, readily available sources of fatty acids such as tallow, possess odors that remain with the softener compounds despite the chemical and mechanical processing steps which convert the raw tallow to finished active. Such sources must be deodorized, e.g., by absorption, distillation (including stripping such as steam stripping), etc., as is well known in the art. In addition, care must be taken to minimize contact of the resulting fatty acyl groups to oxygen and/or bacteria by adding antioxidants, antibacterial agents, etc. The additional expense and effort associated with the unsaturated fatty acyl groups is justified by the superior concentratability and/or performance which was not heretofore recognized. For example, DEQA containing unsaturated fatty acyl groups having an IV greater than about 10 can be concentrated above about 13% without the need for additional concentration aids, especially surfactant concentration aids as discussed hereinafter.

The above softener actives derived from highly unsaturated fatty acyl groups, i.e., fatty acyl groups having a total unsaturation above about 65% by weight, do not provide any additional improvement in antistatic effectiveness. They may, however, be able to provide other benefits such as improved water absorbency of the fabrics. In general, an IV range of from about 40 to about 65 is preferred for concentratability, maximization of fatty acyl sources, excellent softness, static control, etc.

Highly concentrated aqueous dispersions of these softener compounds can gel and/or thicken during low (5° C.) temperature storage. Softener compounds made from only unsaturated fatty acids minimizes this problem but additionally is more likely to cause malodor formation. Surprisingly, compositions from these softener compounds made from fatty acids having an IV of from about 5 to about 25, preferably from about 10 to about 25, more preferably from about 15 to about 20, and a cis/trans isomer weight ratio of from greater than about 30/70, preferably greater than about 50/50, more preferably greater than about 70/30, are storage stable at low temperature with minimal odor formation. These cis/trans isomer weight ratios provide optimal concentratability at these IV ranges. In the IV range above about 25, the ratio of cis to trans isomers is less important unless higher concentrations are needed. The relationship between IV and concentratability is described hereinafter. For any IV, the concentration that will be stable in an aqueous composition will depend on the criteria for stability (e.g., stable down to about 5° C.; stable down to 0° C.; doesn't gel; gels but recovers on heating, etc.) and the other ingredients present, but the concentration that is stable can be raised by adding the concentration aids, described hereinafter in more detail, to achieve the desired stability.

Generally, hydrogenation of fatty acids to reduce polyunsaturation and to lower IV to insure good color and improve odor and odor stability leads to a high degree of trans configuration in the molecule. Therefore, diester compounds derived from fatty acyl groups having low IV values can be made by mixing fully hydrogenated fatty acid with touch hydrogenated fatty acid at a ratio which provides an IV of from about 5 to about 25. The polyunsaturation content of the touch hardened fatty acid should be less than about 5%, preferably less than about 1%. During touch hardening the cis/trans isomer weight ratios are controlled by methods known in the art such as by optimal mixing, using specific catalysts, providing high $H_2$ availability, etc. Touch hardened fatty acid with high cis/trans isomer weight ratios is available commercially (i.e., Radiacid 406 from FINA).

It has also been found that for good chemical stability of the diester quaternary compound in molten storage, moisture level in the raw material must be controlled and minimized preferably less than about 1% and more preferably less than about 0.5% water. Storage temperatures should be kept as low as possible and still maintain a fluid material, ideally in the range of from about 49° C. to about 66° C. The optimum storage temperature for stability and fluidity depends on the specific IV of the fatty acid used to make the softener compound and the level/type of solvent selected. It is important to provide good molten storage stability to provide a commercially feasible raw material that will not degrade noticeably in the normal transportation/storage/handling of the material in manufacturing operations.

It will be understood that substituents R and $R^1$ can optionally be substituted with various groups such as alkoxyl or hydroxyl groups. The preferred compounds can be considered to be diester variations of ditallow dimethyl ammonium chloride (DTDMAC), which is a widely used fabric softener. At least 80% of the softener compound, i.e., DEQA is preferably in the diester form, and from 0% to about 20%, preferably less than about 10%, more preferably less than about 5%, can be monoester, i.e., DEQA monoester (e.g., containing only one —Y—$R^1$ group).

As used herein, when the diester is specified, it will include the monoester that is normally present in manufacture. For softening, under no/low detergent carry-over laundry conditions the percentage of monoester should be as low as possible, preferably no more than about 2.5%. However, under high detergent carry-over conditions, some monoester is preferred. The overall ratios of diester to monoester are from about 100:1 to about 2:1, preferably from about 50:1 to about 5:1, more preferably from about 13:1 to about 8:1. Under high detergent carry-over conditions, the di/monoester ratio is preferably about 11:1. The level of monoester present can be controlled in the manufacturing of the softener compound.

The following are non-limiting examples (wherein all long-chain alkyl substituents are straight-chain):

Saturated $$(HO—CH(CH_3)CH_2)(CH_3)^+N(CH_2CH_2OC(O)C_{15}H_{31})_2\ Br^-$$

$$(C_2H_5)_2{}^+N(CH_2CH_2OC(O)C_{17}H_{35})_2\ Cl^-$$

$$(CH_3)(C_2H_5)^+N(CH_2CH_2OC(O)C_{13}H_{27})_2\ I^-$$

$$(C_3H_7)(C_2H_5)^+N(CH_2CH_2OC(O)C_{15}H_{31})_2\ (CH_3SO_4)^-$$

$$(CH_3)_2{}^+N—(CH_2CH_2OC(O)C_{17}H_{35})\ (CH_2CH_2OC(O)C_{15}H_{31})\ Cl^-$$

$$(CH_3)_2{}^+N(CH_2CH_2OC(O)R^2)_2\ Cl^-$$

where —$C(O)R^2$ is derived from saturated tallow.

Unsaturated $$(HO—CH(CH_3)CH_2)(CH_3)^+N(CH_2CH_2OC(O)C_{15}H_{29})_2\ Br^-$$

$$(C_2H_5)_2{}^+N(CH_2CH_2OC(O)C_{17}H_{33})_2\ Cl^-$$

$$(CH_3)(C_2H_5)^+N(CH_2CH_2OC(O)C_{13}H_{25})_2\ I^-$$

$$(C_3H_7)(C_2H_5)^+N(CH_2CH_2OC(O)C_{15}H_{29})_2\ (CH_3SO_4)^-$$

$$(CH_3)_2{}^+N—(CH_2CH_2OC(O)C_{17}H_{33})\ (CH_2CH_2OC(O)C_{15}H_{29})\ Cl^-$$

$$(CH_2CH_2OH)(CH_3)^+N(CH_2CH_2OC(O)R^2)_2\ Cl^-$$

$$(CH_3)_2{}^{+N(CH}{}_2CH_2OC(O)R^2)_2\ Cl^-$$

where —$C(O)R^2$ is derived from partially hydrogenated tallow or modified tallow having the characteristics set forth herein.

It is especially surprising that careful pH control can noticeably improve product odor stability of compositions using unsaturated softener compound.

In addition, since the foregoing compounds (diesters) are somewhat labile to hydrolysis, they should be handled rather carefully when used to formulate the compositions herein. For example, stable liquid compositions herein are formulated at a pH (neat) in the range of from about 2 to about 5, preferably from about 2 to about 4.5, more preferably from about 2 to about 4. For best product odor stability, when the IV is greater that about 25, the neat pH is from about 2.8 to about 3.5, especially for lightly scented products. This appears to be true for all of the above softener compounds and is especially true for the preferred DEQA specified herein, i.e., having an IV of greater than about 20, preferably greater than about 40. The limitation is more important as IV increases. The pH can be adjusted by the addition of a Bronsted acid. pH ranges for making chemically stable softener compositions containing diester quaternary ammonium fabric softening compounds are disclosed in U.S. Pat. No. 4,767,547, Straathof et al., issued on Aug. 30, 1988, which is incorporated herein by reference.

Examples of suitable Bronsted acids include the inorganic mineral acids, carboxylic acids, in particular the low molecular weight ($C_1$–$C_5$) carboxylic acids, and alkylsulfonic acids. Suitable inorganic acids include HCl, $H_2SO_4$, $HNO_3$ and $H_3PO_4$. Suitable organic acids include formic, acetic, methylsulfonic and ethylsulfonic acid. Preferred acids are hydrochloric, phosphoric, and citric acids.

The diester quaternary ammonium fabric softening compound (DEQA) can also have the general formula:

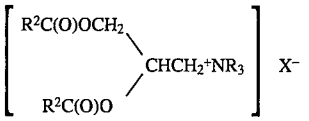

wherein each R, $R^2$, and the counterion $X^-$ have the same meanings as before. Such compounds include those having the formula:

$$(CH_3)_3{}^+N(CH_2CH(CH_2OC(O)R^2)OC(O)R^2)\ Cl^-$$

where $OC(O)R^2$ is derived from hardened tallow.

Preferably each R is a methyl or ethyl group and preferably each $R^2$ is in the range of $C_{15}$ to $C_{19}$. Degrees of branching, substitution and/or non-saturation can be present in the alkyl chains. The anion $X^-$ in the molecule is preferably the anion of a strong acid and can be, for example, chloride, bromide, iodide, sulphate and methyl sulphate; the anion can carry a double charge in which case $X^-$ represents half a group. These compounds, in general, are more difficult to formulate as stable concentrated liquid compositions.

These types of compounds and general methods of making them are disclosed in U.S. Pat. No. 4,137,180, Naik et al., issued Jan. 30, 1979, which is incorporated herein by reference.

Liquid compositions of this invention typically contain from about 0.5% to about 80%, preferably from about 1% to about 35%, more preferably from about 4% to about 32%, of biodegradable diester quaternary ammonium softener active. Concentrated compositions are disclosed in allowed U.S. patent application Ser. No. 08/169,858, filed Dec. 17, 1993, Swartley, et al., said application being incorporated herein by reference.

Particulate solid, granular compositions of this invention typically contain from about 50% to about 95%, preferably from about 60% to about 90% of biodegradable diester quaternary ammonium softener active.

(B) Perfumes

During the laundry process, a substantial amount of perfume in the rinse-added fabric softener composition is lost with the rinse water and in the subsequent drying (either line drying or machine drying). This has resulted in both a waste of unusable perfumes that are not deposited on laundered fabrics, and a contribution to the general air pollution from the release of volatile organic compounds to the air.

We have now discovered that a class of long lasting perfume ingredients can be formulated into fabric softener compositions and are substantially deposited and remain on fabrics throughout the rinse and drying steps. These perfume ingredients, as described hereinbefore, when used in conjunction with the rapidly biodegradable fabric softener ingredients, represent more environmentally friendly fabric softener compositions, with minimum material waste, which still provide the good fabric feel and smell the consumers value.

The products described herein can also contain from about 0.1% to about 15% of non-derivatized enduring perfume compositions that are typically found in conventional fabric softener compositions. Fabric softener compositions in the art commonly contain perfumes to provide a good odor to fabrics. These conventional perfume compositions are normally selected mainly for their odor quality, with some consideration of fabric substantivity. Typical perfume compounds and compositions can be found in the art including U.S. Pat. Nos. 4,145,184, Brain and Cummins, issued Mar. 20, 1979; 4,209,417, Whyte, issued Jun. 24, 1980; 4,515,705, Moeddel, issued May 7, 1985; and 4,152,272, Young, issued May 1, 1979, all of said patents being incorporated herein by reference.

These non-derivatized enduring perfume ingredients are characterized by their boiling points (B.P.) and their octanol/water partitioning coefficient (P). Octanol/water partitioning coefficient of a perfume ingredient is the ratio between its equilibrium concentration in octanol and in water. The perfume ingredients of this invention has a B.P., measured at the normal, standard pressure, of about 250° C. or higher, e.g., more than about 260° C.; and an octanol/water partitioning coefficient P of about 1,000 or higher. Since the partitioning coefficients of the perfume ingredients of this invention have high values, they are more conveniently given in the form of their logarithm to the base 10, logP. Thus the perfume ingredients of this invention have logP of about 3 or higher, e.g., more than about 3.1 preferably more than about 3.2.

The logP of many perfume ingredients has been reported; for example, the Pomona92 database, available from Daylight Chemical Information Systems, Inc. (Daylight CIS), Irvine, Calif., contains many, along with citations to the original literature. However, the logP values are most conveniently calculated by the "CLOGP" program, also available from Daylight CIS. This program also lists experimental logP values when they are available in the Pomona92 database. The "calculated logP" (ClogP) is determined by the fragment approach on Hansch and Leo (cf., A. Leo, in Comprehensive Medicinal Chemistry, Vol. 4, C. Hansch, P. G. Sammens, J. B. Taylor and C. A. Ransden, Eds., p. 295, Pergamon Press, 1990, incorporated herein by reference). The fragment approach is based on the chemical structure of each perfume ingredient, and takes into account the numbers and types of atoms, the atom connectivity, and chemical bonding. The ClogP values, which are the most reliable and widely used estimates for this physicochemical property, are preferably used instead of the experimental logP values in the selection of perfume ingredients which are useful in the present invention.

The boiling points of many perfume ingredients are given in, e.g., "Perfume and Flavor Chemicals (Aroma Chemicals)," S. Arctander, published by the author, 1969, incorporated herein by reference. Other boiling point values can be obtained from different chemistry handbooks and databases, such as the Beilstein Handbook, Lange's Handbook of Chemistry, and the CRC Handbook of Chemistry and Physics. When a boiling point is given only at a different pressure, usually lower pressure than the normal pressure of 760 mm Hg, the boiling point at normal pressure can be approximately estimated by using boiling point-pressure nomographs, such as those given in "The Chemist's Companion," A. J. Gordon and R. A. Ford, John Wiley & Sons Publishers, 1972, pp. 30–36. When applicable, the boiling point values can also be calculated by computer programs, based on molecular structural data, such as those described in "Computer-Assisted Prediction of Normal Boiling Points of Pyrans and Pyrroles," D. T. Stanton et al, J. Chem. Inf. Comput. Sci., 32 (1992), pp. 306–316, "Computer-Assisted Prediction of Normal Boiling Points of Furans, Tetrahydrofurans, and Thiophenes," D. T. Stanton et al, J. Chem. Inf. Comput. Sci., 31 (1992), pp. 301–310, and references cited therein, and "Predicting Physical Properties from Molecular Structure," R. Murugan et al, Chemtech, June 1994, pp. 17–23. All the above publications are incorporated herein by reference.

Thus, when a perfume composition which is composed primarily of ingredients having a B.P. at about 250° C., or higher, and a ClogP of about 3, or higher, is used in a softener composition, the perfume is very effectively deposited on fabrics and remains substantive on fabrics after the rinsing and drying (line or machine drying) steps.

TABLE 1

Examples of Enduring Perfume Ingredients

| Perfume Ingredients | Approximate B.P. (°C.)(a) | ClogP |
|---|---|---|
| BP > 250° C. and ClogP > 3.0 | | |
| Allyl cyclohexane propionate | 267 | 3.935 |
| Ambrettolide | 300 | 6.261 |
| Amyl benzoate | 262 | 3.417 |
| Amyl cinnamate | 310 | 3.771 |
| Amyl cinnamic aldehyde | 285 | 4.324 |
| Amyl cinnamic aldehyde dimethyl acetal | 300 | 4.033 |
| iso-Amyl salicylate | 277 | 4.601 |
| Aurantiol | 450 | 4.216 |
| Benzophenone | 306 | 3.120 |
| Benzyl salicylate | 300 | 4.383 |
| para-tert-Butyl cyclohexyl acetate | +250 | 4.019 |
| iso-Butyl quinoline | 252 | 4.193 |
| beta-Caryophyllene | 256 | 6.333 |
| Cadinene | 275 | 7.346 |
| Cedrol | 291 | 4.530 |
| Cedryl acetate | 303 | 5.436 |
| Cedryl formate | +250 | 5.070 |
| Cinnamyl cinnamate | 370 | 5.480 |
| Cyclohexyl salicylate | 304 | 5.265 |
| Cyclamen aldehyde | 270 | 3.680 |
| Dihydro isojasmonate | +300 | 3.009 |
| Diphenyl methane | 262 | 4.059 |
| Diphenyl oxide | 252 | 4.240 |
| Dodecalactone | 258 | 4.359 |
| iso E super | +250 | 3.455 |
| Ethylene brassylate | 332 | 4.554 |
| Ethyl methyl phenyl glycidate | 260 | 3.165 |
| Ethyl undecylenate | 264 | 4.888 |
| Exiltolide | 280 | 5.346 |
| Galaxolide | +250 | 5.482 |
| Geranyl anthranilate | 312 | 4.216 |
| Geranyl phenyl acetate | +250 | 5.233 |
| Hexadecanolide | 294 | 6.805 |
| Hexenyl salicylate | 271 | 4.716 |
| Hexyl cinnamic aldehyde | 305 | 5.473 |
| Hexyl salicylate | 290 | 5.260 |
| alpha-Irone | 250 | 3.820 |
| Lilial (p-t-bucinal) | 258 | 3.858 |
| Linalyl benzoate | 263 | 5.233 |
| 2-Methoxy naphthalene | 274 | 3.235 |
| Methyl dihydrojasmone | +300 | 4.843 |
| gamma-n-Methyl ionone | 252 | 4.309 |
| Musk indanone | +250 | 5.458 |
| Musk ketone | MP = 137° C. | 3.014 |
| Musk tibetine | MP = 136° C. | 3.831 |
| Myristicin | 276 | 3.200 |
| Oxahexadecanolide-10 | +300 | 4.336 |
| Oxahexadecanolide-11 | MP = 35° C. | 4.336 |
| Patchouli alcohol | 285 | 4.530 |
| Phantolide | 288 | 5.977 |
| Phenyl ethyl benzoate | 300 | 4.058 |
| Phenylethylphenylacetate | 325 | 3.767 |
| Phenyl heptanof | 261 | 3.478 |
| Phenyl hexanol | 258 | 3.299 |
| alpha-Santalol | 301 | 3.800 |
| Thibetolide | 280 | 6.246 |
| delta-Undecalactone | 290 | 3.830 |
| gamma-Undecalactone | 297 | 4.140 |
| Vetiveryl acetate | 285 | 4.882 |

TABLE 1-continued

Examples of Enduring Perfume Ingredients

| Perfume Ingredients | Approximate B.P. (°C.)(a) | ClogP |
|---|---|---|
| Yara-yara | 274 | 3.235 |
| Ylangene | 250 | 6.268 |

(a)M.P. is melting point; these ingredients have a B.P. higher than 250° C.

Table 1 gives some non-limiting examples of non-derivatized enduring perfume ingredients, useful in softener compositions of the present invention. The non-derivatized enduring perfume compositions of the present invention contain at least about 3 different enduring perfume ingredients, more preferably at least about 4 different enduring perfume ingredients, and even more preferably at least about 5 different enduring perfume ingredients. Furthermore, the non-derivatized enduring perfume compositions of the present invention contain at least about 70 Wt. % of enduring perfume ingredients, preferably at least about 75 Wt. % of enduring perfume ingredients, more preferably at least about 85 Wt. % of enduring perfume ingredients. Fabric softening compositions of the present invention contain from about 0.01% to about 15%, preferably from about 0.05% to about 8%, more preferably from about 0.1% to about 6%, and even more preferably from about 0.15% to about 4%, of non-derivatized enduring perfume composition.

In the perfume art, some materials having no odor or very faint odor are used as diluents or extenders. Non-limiting examples of these materials are dipropylene glycol, diethyl phthalate, triethyl citrate, isopropyl myristate, and benzyl benzoate. These materials are used for, e.g., diluting and stabilizing some other perfume ingredients. These materials are not counted in the formulation of the non-derivatized enduring perfume compositions of the present invention.

TABLE 2

Examples of Non-Enduring Perfume Ingredients

| Perfume Ingredients | Approximate B.P. (°C.)(a) | ClogP |
|---|---|---|
| BP < 250° C. and ClogP < 3.0 | | |
| Benzaidehyde | 179 | 1.480 |
| Benzyl acetate | 215 | 1.960 |
| laevo-Carvone | 231 | 2.083 |
| Geranioi | 230 | 2.649 |
| Hydroxycitronelial | 241 | 1.541 |
| cis-Jasmone | 248 | 2.712 |
| Linalool | 198 | 2.429 |
| Nerol | 227 | 2.649 |
| Phenyl ethyl alcohol | 220 | 1.183 |
| alpha-Terpineol | 219 | 2.569 |
| BP > 250° C. and ClogP < 3.0 | | |
| Coumarin | 291 | 1.412 |
| Eugenol | 253 | 2.307 |
| iso-Eugenol | 266 | 2.547 |
| Indole | 254 decompos | 2.142 |
| Methyl cinnamate | 263 | 2.620 |
| Methyl dihydrojasmonate | +300 | 2.275 |
| Methyl-N-methyl anthranilate | 256 | 2.791 |
| beta-Methyl naphthyl ketone | 300 | 2.275 |
| delta-Nonalactone | 280 | 2.760 |
| Vanillin | 285 | 1.580 |
| BP < 250° C. and ClogP > 3.0 | | |
| iso-Bornyl acetate | 227 | 3.485 |
| Carvacrol | 238 | 3.401 |

TABLE 2-continued

Examples of Non-Enduring Perfume Ingredients

| Perfume Ingredients | Approximate B.P. (°C.)(a) | ClogP |
|---|---|---|
| alpha-Citronellol | 225 | 3.193 |
| para-Cymene | 179 | 4.068 |
| Dihydro myrenol | 208 | 3.030 |
| Geranyl acetate | 245 | 3.715 |
| d-Limonene | 177 | 4.232 |
| Linalyl acetate | 220 | 3.500 |
| Vertenex | 232 | 4,060 |

Non-enduring perfume ingredients, which are preferably minimized in softener compositions of the present invention, are those having a B.P. of less than about 250° C., or having a ClogP of less than about 3.0, or having both a B.P. of less than about 250° C. and a ClogP of less than about 3.0. Table 2 gives some non-limiting examples of non-enduring perfume ingredients. In some particular fabric softener compositions, some non-enduring perfume ingredients can be used in small amounts, e.g., to improve product odor.

The combination of these traditional non-derivatized perfume compositions with those of the present invention contributes to the overall perfume odor intensity, giving rise to a longer lasting perfume odor impression.

(C). Optional Viscosity/Dispersibility Modifiers

Viscosity/dispersibility modifiers can be added for the purpose of facilitating the solubilization and/or dispersion of the solid compositions, concentrating the liquid compositions, and/or improving phase stability (e.g., viscosity stability) of the liquid compositions herein, including the liquid compositions formed by adding the solid compositions to water.

(1) Single-Long—Chain Alkyl Cationic Surfactant

The mono-long-chain-alkyl (water-soluble) cationic surfactants:

(a) in particulate, granular solid compositions are at a level of from 0% to about 30%, preferably from about 3% to about 15%, more preferably from about 5% to about 15%, and (b). in liquid compositions are at a level of from 0% to about 30%, preferably from about 0.5% to about 10%, the total single-long-chain cationic surfactant present being at least at an effective level.

Such mono-long-chain-alkyl cationic surfactants useful in the present invention are, preferably, quaternary ammonium salts of the general formula:

$$(R_2N^+R_3)\ X^-$$

wherein the $R^2$ group is a $C_{10}$–$C_{22}$ hydrocarbon group, preferably $C_{12}$–$C_{18}$ alkyl group or the corresponding ester linkage interrupted-group with a short alkylene ($C_1$–$C_4$) group between the ester linkage and the N, and having a similar hydrocarbon group, e.g., a fatty acid ester of choline, preferably $C_{12}$–$C_{14}$ (coco) choline ester and/or $C_{16}$–$C_{18}$ tallow choline ester; each R is a $C_1$–$C_4$ alkyl or substituted (e.g., hydroxy) alkyl, or hydrogen, preferably methyl, and the counterion $X^-$ is a softener compatible anion, for example, chloride, bromide, methyl sulfate, etc.

The ranges above represent the amount of the single-long-chain-alkyl cationic surfactant which is preferably added to the composition of the present invention. The ranges do not include the amount of monoester which is already present in component (A), the diester quaternary ammonium compound, the total present being at least at an effective level.

The long chain group $R^2$, of the single-long-chain-alkyl cationic surfactant, typically contains an alkyl, or alkylene group having from about 10 to about 22 carbon atoms, preferably from about 12 to about 16 carbon atoms for solid compositions, and preferably from about 12 to about 18 carbon atoms for liquid compositions. This $R^2$ group can be attached to the cationic nitrogen atom through a group containing one, or more, ester, amide, ether, amine, etc., preferably ester, linking groups which can be desirable for increased hydrophilicity, biodegradability, etc. Such linking groups are preferably within about three carbon atoms of the nitrogen atom. Suitable biodegradable single-long-chain alkyl cationic surfactants containing an ester linkage in the long chain are described in U.S. Pat. No. 4,840,738, Hardy and Walley, issued Jun. 20, 1989, said patent being incorporated herein by reference.

If the corresponding, non-quaternary amines are used, any acid (preferably a mineral or polycarboxylic acid) which is added to keep the ester groups stable will also keep the amine protonated in the compositions and preferably during the rinse so that the amine has a cationic group. The composition is buffered (pH from about 2 to about 5, preferably from about 2 to about 4) to maintain an appropriate, effective charge density in the aqueous liquid concentrate product and upon further dilution e.g., to form a less concentrated product and/or upon addition to the rinse cycle of a laundry process.

It will be understood that the main function of the water-soluble cationic surfactant is to lower the composition's viscosity and/or increase the dispersibility of the diester softener compound and it is not, therefore, essential that the cationic surfactant itself have substantial softening properties, although this can be the case. Also, surfactants having only a single long alkyl chain, presumably because they have greater solubility in water, can protect the diester softener from interacting with anionic surfactants and/or detergent builders that are carried over into the rinse.

Other cationic materials with ring structures such as alkyl imidazoline, imidazolinium, pyridine, and pyridinium salts having a single $C_{12}$–$C_{30}$ alkyl chain can also be used. Very low pH is required to stabilize, e.g., imidazoline ring structures.

Some alkyl imidazolinium salts useful in the present invention have the general formula:

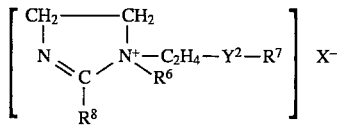

wherein $Y^2$ is —C(O)—O—, —O—(O)—C—, —C(O)—N($R^5$), or —N($R^5$)—C(O)— in which $R^5$ is hydrogen or a $C_1$–$C_4$ alkyl radical; $R^6$ is a $C_1$–$C_4$ alkyl radical; $R^7$ and $R^8$ are each independently selected from R and $R^2$ as defined hereinbefore for the single-long-chain cationic surfactant with only one being $R^2$.

Some alkyl pyridinium salts useful in the present invention have the general formula:

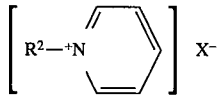

wherein $R^2$ and $X^-$ are as defined above. A typical material of this type is cetyl pyridinium chloride.

Amine oxides can also be used. Suitable amine oxides include those with one alkyl, or hydroxyalkyl, moiety of about 8 to about 22 carbon atoms, preferably from about 10 to about 18 carbon atoms, more preferably from about 12 to about 14 carbon atoms, and two alkyl moieties selected from the group consisting of alkyl groups and hydroxyalkyl groups containing from one to about three carbon atoms.

Examples of amine oxides include: dimethyloctylamine oxide; diethyldecylamine oxide; dimethyldodecylamine oxide; dipropyltetradecylamine oxide; dimethyl-2-hydroxyoctadecylamine oxide; dimethylcoconutalkylamine oxide; and bis-( 2-hydroxyethyl)dodecylamine oxide.

(2) Nonionic Surfactant (Alkoxylated Materials)

Suitable nonionic surfactants to serve as the viscosity/dispersibility modifier include addition products of ethylene oxide and, optionally, propylene oxide, with fatty alcohols, fatty acids, fatty amines, etc. They are referred to herein as ethoxylated fatty alcohols, ethoxylated fatty acids, and ethoxylated fatty amines.

Any of the alkoxylated materials of the particular type described hereinafter can be used as the nonionic surfactant. In general terms, the nonionics herein, when used alone, in solid compositions are at a level of from about 5% to about 20%, preferably from about 8% to about 15%, and in liquid compositions are at a level of from 0% to about 5%, preferably from about 0.1% to about 5%, more preferably from about 0.2% to about 3%. Suitable compounds are substantially water-soluble surfactants of the general formula:

$$R^2—Y—(C_2H_4O)_z—C_2H_4OH$$

wherein $R^2$ for both solid and liquid compositions is selected from the group consisting of primary, secondary and branched chain alkyl and/or acyl hydrocarbyl groups; primary, secondary and branched chain alkenyl hydrocarbyl groups; and primary, secondary and branched chain alkyl- and alkenyl-substituted phenolic hydrocarbyl groups; said hydrocarbyl groups having a hydrocarbyl chain length of from about 8 to about 20, preferably from about 10 to about 18 carbon atoms. More preferably the hydrocarbyl chain length for liquid compositions is from about 16 to about 18 carbon atoms and for solid compositions from about 10 to about 14 carbon atoms. In the general formula for the ethoxylated nonionic surfactants herein, Y is typically —O—, —C(O)O—, —C(O)N(R)—, or —C(O)N(R)R—, preferably —O—, and in which $R^2$, and R, when present, have the meanings given hereinbefore, and/or R can be hydrogen, and z is at least about 8, preferably at least about 10–11. Performance and, usually, stability of the softener composition decrease when fewer ethoxylate groups are present.

The nonionic surfactants herein are characterized by an HLB (hydrophilic-lipophilic balance) of from about 7 to about 20, preferably from about 8 to about 15. Of course, by defining $R^2$ and the number of ethoxylate groups, the HLB of the surfactant is, in general, determined. However, it is to be noted that the nonionic ethoxylated surfactants useful herein, for concentrated liquid compositions, contain relatively long chain $R^2$ groups and are relatively highly ethoxylated. While shorter alkyl chain surfactants having short ethoxylated groups can possess the requisite HLB, they are not as effective herein.

Nonionic surfactants as the viscosity/dispersibility modifiers are preferred over the other modifiers disclosed herein for compositions with higher levels of perfume.

Examples of nonionic surfactants follow. The nonionic surfactants of this invention are not limited to these examples. In the examples, the integer defines the number of ethoxy (EO) groups in the molecule.

(3) Straight-Chain, Primary Alcohol Alkoxylates

The deca-, undeca-, dodeca-, tetradeca-, and pentadeca-ethoxylates of n-hexadecanol, and n-octadecanol having an HLB within the range recited herein are useful viscosity/dispersibility modifiers in the context of this invention. Exemplary ethoxylated primary alcohols useful herein as the viscosity/dispersibility modifiers of the compositions are n—$C_{18}$EO(10); and n—$C_{10}$EO(11). The ethoxylates of mixed natural or synthetic alcohols in the "tallow" chain length range are also useful herein. Specific examples of such materials include tallowalcohol-EO(11), tallowalcohol-EO(18), and tallowalcohol-EO(25).

(4) Straight-Chain, Secondary Alcohol Alkoxylates

The deca-, undeca-, dodeca-, tetradeca-, pentadeca-, octadeca-, and nonadeca-ethoxylates of 3-hexadecanol, 2-octadecanol, 4-eicosanol, and 5-eicosanol having and HLB within the range recited herein are useful viscosity/dispersibility modifiers in the context of this invention. Exemplary ethoxylated secondary alcohols useful herein as the viscosity/dispersibility modifiers of the compositions are: 2—$C_{16}$EO(11); 2—$C_{20}$EO(11); and 2—$C_{16}$EO(14).

(5) Alkyl Phenol Alkoxylates

As in the case of the alcohol alkoxylates, the hexa- through octadeca-ethoxylates of alkylated phenols, particularly monohydric alkylphenols, having an HLB within the range recited herein are useful as the viscosity/dispersibility modifiers of the instant compositions. The hexa- through octadeca-ethoxylates of p-tridecylphenol, m-pentadecylphenol, and the like, are useful herein. Exemplary ethoxylated alkylphenols useful as the viscosity/dispersibility modifiers of the mixtures herein are: p-tridecylphenol EO(11) and p-pentadecylphenol EO(18).

As used herein and as generally recognized in the art, a phenylene group in the nonionic formula is the equivalent of an alkylene group containing from 2 to 4 carbon atoms. For present purposes, nonionics containing a phenylene group are considered to contain an equivalent number of carbon atoms calculated as the sum of the carbon atoms in the alkyl group plus about 3.3 carbon atoms for each phenylene group.

(6) Olefinic Alkoxylates

The alkenyl alcohols, both primary and secondary, and alkenyl phenols corresponding to those disclosed immediately hereinabove can be ethoxylated to an HLB within the range recited herein and used as the viscosity/dispersibility modifiers of the instant compositions.

(7) Branched Chain Alkoxylates

Branched chain primary and secondary alcohols which are available from the well-known "OXO" process can be ethoxylated and employed as the viscosity/dispersibility modifiers of compositions herein.

The above ethoxylated nonionic surfactants are useful in the present compositions alone or in combination, and the term "nonionic surfactant" encompasses mixed nonionic surface active agents.

(8) Mixtures

The term "mixture" includes the nonionic surfactant and the single-long-chain-alkyl cationic surfactant added to the composition in addition to any monoester present in the DEQA.

Mixtures of the above viscosity/dispersibility modifiers are highly desirable. The single long chain cationic surfactant provides improved dispersibility and protection for the primary DEQA against anionic surfactants and/or detergent builders that are carried over from the wash solution.

The viscosity/dispersibility modifiers are present for solid compositions at a level of from about 3% to about 30%, preferably from about 5% to about 20%, and for liquid compositions at a level of from about 0.1% to about 30%, preferably from about 0.2% to about 20%, by weight of the composition.

As discussed hereinbefore, a potential source of water-soluble, cationic surfactant material is the DEQA itself. As a raw material, DEQA comprises a small percentage of monoester. Monoester can be formed by either incomplete esterification or by hydrolyzing a small amount of DEQA and thereafter extracting the fatty acid by-product. Generally, the composition of the present invention should only have low levels of, and preferably is substantially free of, free fatty acid by-product or free fatty acids from other sources because it inhibits effective processing of the composition. The level of free fatty acid in the compositions of the present invention is no greater than about 5% by weight of the composition and preferably no greater than 25% by weight of the diester quaternary ammonium compound.

Di-substituted imidazoline ester softening compounds, imidazoline alcohols, and monotallow trimethyl ammonium chloride are discussed hereinbefore and hereinafter.

(D) Liquid Carrier

The liquid carrier employed in the instant compositions is preferably water due to its low cost, relative availability, safety, and environmental compatibility. The level of water in the liquid carrier is more than about 50%, preferably more than about 80%, more preferably more than about 85%, by weight of the carrier. The level of liquid carrier is greater than about 50%, preferably greater than about 65%, more preferably greater than about 70%. Mixtures of water and low molecular weight, e.g., <about 100, organic solvent, e.g., lower alcohol such as ethanol, propanol, isopropanol or butanol; propylene carbonate; and/or glycol ethers, are useful as the carrier liquid. Low molecular weight alcohols include monohydric, dihydric (glycol, etc.) trihydric (glycerol, etc.), and polyhydric (polyols) alcohols).

(E) Other Optional Ingredients

In addition to the above components, the composition can have one or more of the following optional ingredients.

1. Stabilizers

Stabilizers can be present in the compositions of the present invention. The term "stabilizer," as used herein, includes antioxidants and reductive agents. These agents are present at a level of from 0% to about 2%, preferably from about 0.01% to about 0.2%, more preferably from about 0.035% to about 0.1% for antioxidants, and more preferably from about 0.01% to about 0.2% for reductive agents. These assure good odor stability under long term storage conditions for the compositions and compounds stored in molten form. The use of antioxidants and reductive agent stabilizers is especially critical for low scent products (low perfume).

Examples of antioxidants that can be added to the compositions of this invention include a mixture of ascorbic acid, ascorbic palmitate, propyl gallate, available from Eastman Chemical Products, Inc., under the trade names Tenox® PG and Tenox S-1; a mixture of BHT (butylated hydroxytoluene), BHA (butylated hydroxyanisole), propyl gallate, and citric acid, available from Eastman Chemical Products, Inc., under the trade name Tenox-6; butylated hydroxytoluene, available from UOP Process Division under the trade name Sustane® BHT; tertiary butylhydroquinone, Eastman Chemical Products, Inc., as Tenox TBHQ; natural tocopherols, Eastman Chemical Products, Inc., as Tenox GT-1/GT-2; and butylated hydroxyanisole, Eastman Chemical Products, Inc., as BHA; long chain esters ($C_8$–$C_{22}$) of gallic acid, e.g., dodecyl gallate; Irganox® 1010; Irganox® 1035; Irganox® B 1171; Irganox® 1425; Irganox® 3114; Irganox® 3125; and mixtures thereof; preferably Irganox® 3125, Irganox® 1425, Irganox® 3114, and mixtures thereof; more preferably Irganox® 3125 alone or mixed with citric acid and/or other chelators such as isopropyl citrate, Dequest® 2010, available from Monsanto with a chemical name of 1-hydroxyethylidene-1, 1-diphosphonic acid (etidronic acid), and Tiron®, available from Kodak with a chemical name of 4,5-dihydroxy-m-benzene-sulfonic acid/sodium salt, and DTPA®, available from Aldrich with a chemical name of diethylenetriaminepentaacetic acid. The chemical names and GAS numbers for some of the above stabilizers are listed in Table II below.

TABLE II

| Antioxidant | CAS No. | Chemical Name used in Codeof Federal Regulations |
|---|---|---|
| Irganox ® 1010 | 6683-19-8 | Tetrakis (methylene(3,5-di-tert-butyl-4 hydroxyhydrocinnamate))methane |
| Irganox ® 1035 | 41484-35-9 | Thiodiethylene bis(3,5-di-tert-butyl-4-hydroxyhydrocinnamate |
| Irganox ® 1098 | 23128-74-7 | N,N'-Hexamethylene bis(3,5-di-tert-butyl-4-hydroxyhydrocinnamamide |
| Irganox ® B 1171 | 31570-04-4<br>23128-74-7 | 1:1 Blend of Irganox ® 1098 and Irgafos ® 168 |
| Irganox ® 1425 | 65140-91-2 | Calcium bis(monoethyl(3,5-di-tert-butyl-4-hydroxybenzyl)phosphonate) |
| Irganox ® 3114 | 65140-91-2 | Calcium bis(monoethyl(3,5-di-tert-butyl-4-hydroxybenzyl)phosphonate) |
| Irganox ® 3125 | 34137-09-2 | 3,5-Di-tert-butyl-4-hydroxy-hydrocinnamic acid triesterwith 1,3,5-tris(2-hydroxyethyl)-S-triazine-2,4,6-(1H, 3H, 5H)-trione |
| Irgafos ® 168 | 31570-04-4 | Tris(2,4-di-tert-butyl-phenyl)phosphite |

Examples of reductive agents include sodium borohydride, hypophosphorous acid, Irgafos® 168, and mixtures thereof.

2. Essentially Linear Fatty Acid and/or Fatty Alcohol Monoesters

Optionally, an essentially linear fatty monoester can be added in the composition of the present invention and is often present in at least a small amount as a minor ingredient in the DEQA raw material.

Monoesters of essentially linear fatty acids and/or alcohols, which aid said modifier, contain from about 12 to about 25, preferably from about 13 to about 22, more preferably from about 16 to about 20, total carbon atoms, with the fatty moiety, either acid or alcohol, containing from about 10 to about 22, preferably from about 12 to about 18, more preferably from about 16 to about 18, carbon atoms. The shorter moiety, either alcohol or acid, contains from about 1 to about 4, preferably from about 1 to about 2, carbon atoms. Preferred are fatty acid esters of lower alcohols, especially methanol. These linear monoesters are sometimes present in the DEQA raw material, or can be added to a DEQA premix as a premix fluidizer, and/or added to aid the viscosity/dispersibility modifier in the processing of the softener composition.

3. Optional Nonionic Softener

An optional additional softening agent of the present invention is a nonionic fabric softener material. Typically, such nonionic fabric softener materials have an HLB of from about 2 to about 9, more typically from about 3 to about 7. Such nonionic fabric softener materials tend to be readily dispersed either by themselves, or when combined with other materials such as single-long-chain alkyl cationic surfactant described in detail hereinbefore. Dispersibility can be improved by using more single-long-chain alkyl cationic surfactant, mixture with other materials as set forth hereinafter, use of hotter water, and/or more agitation. In general, the materials selected should be relatively crystalline, higher melting, (e.g., >~50° C.) and relatively water-insoluble.

The level of optional nonionic softener in the solid composition is typically from about 10% to about 40%, preferably from about 15% to about 30%, and the ratio of the optional nonionic softener to DEQA is from about 1:6 to about 1:2, preferably from about 1:4 to about 1:2. The level of optional nonionic softener in the liquid composition is typically from about 0.5% to about 10%, preferably from about 1% to about 5%.

Preferred nonionic softeners are fatty acid partial esters of polyhydric alcohols, or anhydrides thereof, wherein the alcohol, or anhydride, contains from 2 to about 18, preferably from 2 to about 8, carbon atoms, and each fatty acid moiety contains from about 12 to about 30, preferably from about 16 to about 20, carbon atoms. Typically, such softeners contain from about one to about 3, preferably about 2 fatty acid groups per molecule.

The polyhydric alcohol portion of the ester can be ethylene glycol, glycerol, poly (e.g., di-, tri-, tetra, penta-, and/or hexa-) glycerol, xylitol, sucrose, erythritol, pentaerythritol, sorbitol or sorbitan. Sorbitan esters and polyglycerol monostearate are particularly preferred.

The fatty acid portion of the ester is normally derived from fatty acids having from about 12 to about 30, preferably from about 16 to about 20, carbon atoms, typical examples of said fatty acids being lauric acid, myristic acid, palmitic acid, stearic acid and behenic acid.

Highly preferred optional nonionic softening agents for use in the present invention are the sorbitan esters, which are esterified dehydration products of sorbitol, and the glycerol esters.

Sorbitol, which is typically prepared by the catalytic hydrogenation of glucose, can be dehydrated in well known fashion to form mixtures of 1,4- and 1,5-sorbitol anhydrides and small amounts of isosorbides. (See U.S. Pat. No. 2,322,821, Brown, issued Jun. 29, 1943, incorporated herein by reference.)

The foregoing types of complex mixtures of anhydrides of sorbitol are collectively referred to herein as "sorbitan." It will be recognized that this "sorbitan" mixture will also contain some free, uncyclized sorbitol.

The preferred sorbitan softening agents of the type employed herein can be prepared by esterifying the "sorbitan" mixture with a fatty acyl group in standard fashion, e.g., by reaction with a fatty acid halide or fatty acid. The esterification reaction can occur at any of the available hydroxyl groups, and various mono-, di-, etc., esters can be prepared. In fact, mixtures of mono-, di-, tri-, etc., esters almost always result from such reactions, and the stoichiometric ratios of the reactants can be simply adjusted to favor the desired reaction product.

For commercial production of the sorbitan ester materials, etherification and esterification are generally accomplished in the same processing step by reacting sorbitol directly with fatty acids. Such a method of sorbitan ester preparation is described more fully in MacDonald; "Emulsifiers:" Processing and Quality Control:, *Journal of the American Oil Chemists' Society,* Vol. 45, October 1968.

Details, including formula, of the preferred sorbitan esters can be found in U.S. Pat. No. 4,128,484, incorporated hereinbefore by reference.

Certain derivatives of the preferred sorbitan esters herein, especially the "lower" ethoxylates thereof (i.e., mono-, di-, and tri-esters wherein one or more of the unesterified —OH groups contain one to about twenty oxyethylene moieties (Tweens®) are also useful in the composition of the present invention. Therefore, for purposes of the present invention, the term "sorbitan ester" includes such derivatives.

For the purposes of the present invention, it is preferred that a significant amount of di- and tri- sorbitan esters are present in the ester mixture. Ester mixtures having from 20–50% mono-ester, 25–50% di-ester and 10–35% of tri- and tetra-esters are preferred.

The material which is sold commercially as sorbitan mono-ester (e.g., monostearate) does in fact contain significant amounts of di- and tri-esters and a typical analysis of sorbitan monostearate indicates that it comprises ca. 27% mono-, 32% di- and 30% tri- and tetra-esters. Commercial sorbitan monostearate therefore is a preferred material. Mixtures of sorbitan stearate and sorbitan palmitate having stearate/palmitate weight ratios varying between 10:1 and 1:10, and 1,5-sorbitan esters are useful. Both the 1,4- and 1,5-sorbitan esters are useful herein.

Other useful alkyl sorbitan esters for use in the softening compositions herein include sorbitan monolaurate, sorbitan monomyristate, sorbitan monopalmitate, sorbitan monobehenate, sorbitan monooleate, sorbitan dilaurate, sorbitan dimyristate, sorbitan dipalmitate, sorbitan distearate, sorbitan dibehenate, sorbitan dioleate, and mixtures thereof, and mixed tallowalkyl sorbitan mono- and di-esters. Such mixtures are readily prepared by reacting the foregoing hydroxy-substituted sorbitans, particularly the 1,4- and 1,5-sorbitans, with the corresponding acid or acid chloride in a simple esterification reaction. It is to be recognized, of course, that commercial materials prepared in this manner will comprise mixtures usually containing minor proportions of uncyclized sorbitol, fatty acids, polymers, isosorbide structures, and the like. In the present invention, it is preferred that such impurities are present at as low a level as possible.

The preferred sorbitan esters employed herein can contain up to about 15% by weight of esters of the $C_{20}$–$C_{26}$, and higher, fatty acids, as well as minor amounts of $C_8$, and lower, fatty esters.

Glycerol and polyglycerol esters, especially glycerol, diglycerol, triglycerol, and polyglycerol mono- and/or di-esters, preferably mono-, are also preferred herein (e.g., polyglycerol monostearate with a trade name of Radiasurf 7248). Glycerol esters can be prepared from naturally occurring triglycerides by normal extraction, purification and/or interesterification processes or by esterification processes of the type set forth hereinbefore for sorbitan esters. Partial esters of glycerin can also be ethoxylated to form usable derivatives that are included within the term "glycerol esters."

Useful glycerol and polyglycerol esters include monoesters with stearic, oleic, palmitic, lauric, isostearic, myristic, and/or behenic acids and the diesters of stearic, oleic, palmitic, lauric, isostearic, behenic, and/or myristic acids. It is understood that the typical mono-ester contains some di- and tri-ester, etc.

The "glycerol esters" also include the polyglycerol, e.g., diglycerol through octaglycerol esters. The polyglycerol polyols are formed by condensing glycerin or epichlorohydrin together to link the glycerol moieties via ether linkages. The mono- and/or diesters of the polyglycerol polyols are preferred, the fatty acyl groups typically being those described hereinbefore for the sorbitan and glycerol esters.

The performance of, e.g., glycerol and polyglycerol monoesters is improved by the presence of the diester cationic material, described hereinbefore.

Still other desirable optional "nonionic" softeners are ion pairs of anionic detergent surfactants and fatty amines, or quaternary ammonium derivatives thereof, e.g., those disclosed in U.S. Pat. No. 4,756,850, Nayar, issued Jul. 12, 1988, said patent being incorporated herein by reference. These ion pairs act like nonionic materials since they do not readily ionize in water. They typically contain at least two long hydrophobic groups (chains).

The ion-pair complexes can be represented by the following formula:

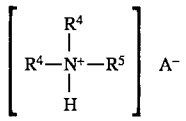

wherein each $R^4$ can independently be $C_{12}$–$C_{20}$ alkyl or alkenyl, and $R^5$ is H or $CH_3$. $A^-$ represents an anionic compound and includes a variety of anionic surfactants, as well as related shorter alkyl chain compounds which need not exhibit surface activity. $A^-$ is selected from the group consisting of alkyl sulfonates, aryl sulfonates, alkyl-aryl sulfonates, alkyl sulfates, dialkyl sulfosuccinates, alkyl oxybenzene sulfonates, acyl isethionates, acylalkyl taurates, alkyl ethoxylated sulfates, olefin sulfonates, preferably benzene sulfonates, and $C_1$–$C_5$ linear alkyl benzene sulfonates, or mixtures thereof.

The terms "alkyl sulfonate" and "linear alkyl benzene sulfonate" as used herein shall include alkyl compounds having a sulfonate moiety both at a fixed location along the carbon chain, and at a random position along the carbon chain. Starting alkyl-amines are of the formula:

$$(R^4)_2—N—R^5$$

wherein each $R^4$ is $C_{12}$–$C_{20}$ alkyl or alkenyl, and $R^5$ is H or $CH_3$.

The anionic compounds ($A^-$) useful in the ion-pair complex of the present invention are the alkyl sulfonates, aryl sulfonates, alkyl-aryl sulfonates, alkyl sulfates, alkyl ethoxylated sulfates, dialkyl sulfosuccinates, ethoxylated alkyl sulfonates, alkyl oxybenzene sulfonates, acyl isethionates, acylalkyl taurates, and paraffin sulfonates.

The preferred anions ($A^-$) useful in the ion-pair complex of the present invention include benzene sulfonates and $C_1$–$C_5$ linear alkyl benzene sulfonates (LAS), particularly $C_1$–$C_3$ LAS. Most preferred is $C_3$ LAS. The benzene sulfonate moiety of LAS can be positioned at any carbon atom of the alkyl chain, and is commonly at the second atom for alkyl chains containing three or more carbon atoms.

More preferred are complexes formed from the combination of ditallow amine (hydrogenated or unhydrogenated) complexed with a benzene sulfonate or $C_1$–$C_5$ linear alkyl benzene sulfonate and distearyl amine complexed with a benzene sulfonate or with a $C_1$–$C_5$ linear alkyl benzene sulfonate. Even more preferred are those complexes formed from hydrogenated ditallow amine or distearyl amine complexed with a $C_1$–$C_3$ linear alkyl benzene sulfonate (LAS). Most preferred are complexes formed from hydrogenated ditallow amine or distearyl amine complexed with $C_3$ linear alkyl benzene sulfonate.

The amine and anionic compound are combined in a molar ratio of amine to anionic compound ranging from about 10:1 to about 1:2, preferably from about 5:1 to about 1:2, more preferably from about 2:1 to about 1:2, and most preferably 1: 1. This can be accomplished by any of a variety of means, including but not limited to, preparing a melt of the anionic compound (in acid form) and the amine, and then processing to the desired particle size range.

A description of ion-pair complexes, methods of making, and non-limiting examples of ion-pair complexes and starting amines suitable for use in the present invention are listed in U.S. Pat. No. 4,915,854, Mao et al., issued Apr. 10, 1990, and U.S. Pat. No. 5,019,280, Caswell et al., issued May 28, 1991, both of said patents being incorporated herein by reference.

Generically, the ion pairs useful herein are formed by reacting an amine and/or a quaternary ammonium salt containing at least one, and preferably two, long hydrophobic chains ($C_{12}$–$C_{30}$, preferably $C_{11}$–$C_{20}$) with an anionic detergent surfactant of the types disclosed in said U.S. Pat. No. 4,756,850, especially at Col. 3, lines 29–47. Suitable methods for accomplishing such a reaction are also described in U.S. Pat. No. 4,756,850, at Col. 3, lines 48–65.

The equivalent ion pairs formed using $C_{12}$–$C_{30}$ fatty acids are also desirable. Examples of such materials are known to be good fabric softeners as described in U.S. Pat. No. 4,237,155, Kardouche, issued Dec. 2, 1980, said patent being incorporated herein by reference.

Other fatty acid partial esters useful in the present invention are ethylene glycol distearate, propylene glycol distearate, xylitol monopalmitate, pentaerythritol monostearate, sucrose monostearate, sucrose distearate, and glycerol monostearate. As with the sorbitan esters, commercially available mono-esters normally contain substantial quantities of di- or tri- esters.

Still other suitable nonionic fabric softener materials include long chain fatty alcohols and/or acids and esters thereof containing from about 16 to about 30, preferably from about 18 to about 22, carbon atoms, esters of such compounds with lower ($C_1$–$C_4$) fatty alcohols or fatty acids, and lower (1–4) alkoxylation ($C_1$–$C_4$) products of such materials.

These other fatty acid partial esters, fatty alcohols and/or acids and/or esters thereof, and alkoxylated alcohols and those sorbitan esters which do not form optimum emulsions/dispersions can be improved by adding other di-long-chain cationic material, as disclosed hereinbefore and hereinafter, or other nonionic softener materials to achieve better results.

The above-discussed nonionic compounds are correctly termed "softening agents," because, when the compounds are correctly applied to a fabric, they do impart a soft, lubricious feel to the fabric. However, they require a cationic material if one wishes to efficiently apply such compounds from a dilute, aqueous rinse solution to fabrics. Good deposition of the above compounds is achieved through their combination with the cationic softeners discussed hereinbefore and hereinafter. The fatty acid partial ester materials are preferred for biodegradability and the ability to adjust the HLB of the nonionic material in a variety of ways, e.g., by varying the distribution of fatty acid chain lengths, degree of saturation, etc., in addition to providing mixtures.

4. Optional Imidazoline Softening Compound

Optionally, the solid composition of the present invention contains from about 1% to about 30%, preferably from about 5% to about 20%, and the liquid composition contains from about 1% to about 20%, preferably from about 1% to about 15%, of a di-substituted imidazoline softening compound of the formula:

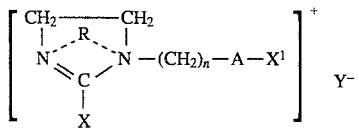

(I)

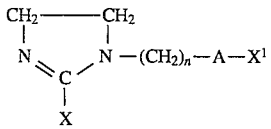

(II)

or mixtures thereof, wherein A is as defined hereinbefore for $Y^2$; $X^1$ and X are, independently, a $C_{11}$–$C_{22}$ hydrocarbyl group, preferably a $C_{13}$–$C_{18}$ alkyl group, most preferably a straight chained tallow alkyl group; R is a $C_1$–$C_4$ hydrocarbyl group, preferably a $C_1$–$C_3$ alkyl, alkenyl or hydroxyalkyl group, e.g., methyl (most preferred), ethyl, propyl, propenyl, hydroxyethyl, 2-, 3-di-hydroxypropyl and the like; and n is, independently, from about 2 to about 4, preferably about 2. The counterion $X^-$ can be any softener compatible anion, for example, chloride, bromide, methylsulfate, ethylsulfate, formate, sulfate, nitrate, and the like.

The above compounds can optionally be added to the composition of the present invention as a DEQA premix fluidizer or added later in the composition's processing for their softening, scavenging, and/or antistatic benefits. When these compounds are added to DEQA premix as a premix fluidizer, the compound's ratio to DEQA is from about 2:3 to about 1:100, preferably from about 1:2 to about 1:50.

Compound (I) can be prepared by quaternizing a substituted imidazoline ester compound. Quaternization can be achieved by any known quaternization method. A preferred quaternization method is disclosed in U.S. Pat. No. 4,954,635, Rosario-Jansen et al., issued Sep. 4, 1990, the disclosure of which is incorporated herein by reference.

The di-substituted imidazoline compounds contained in the compositions of the present invention are believed to be biodegradable and susceptible to hydrolysis due to the ester group on the alkyl substituent. Furthermore, the imidazoline compounds contained in the compositions of the present invention are susceptible to ring opening under certain conditions. As such, care should be taken to handle these compounds under conditions which avoid these consequences. For example, stable liquid compositions herein are preferably formulated at a pH in the range of about 1.5 to about 5.0, most preferably at a pH ranging from about 1.8 to 3.5. The pH can be adjusted by the addition of a Bronsted acid. Examples of suitable Bronsted acids include the inorganic mineral acids, carboxylic acids, in particular the low molecular weight ($C_1$–$C_5$) carboxylic acids, and alkylsulfonic acids. Suitable organic acids include formic, acetic, benzoic, methylsulfonic and ethylsulfonic acid. Preferred acids are hydrochloric and phosphoric acids. Additionally, compositions containing these compounds should be maintained substantially free of unprotonated, acyclic amines.

In many cases, it is advantageous to use a 3-component composition comprising: (A) a diester quaternary ammonium cationic softener such as di(tallowoyloxy ethyl) dimethylammonium chloride; (B) a viscosity/dispersibility modifier, e.g., mono-long-chain alkyl cationic surfactant such as fatty acid choline ester, cetyl or tallow alkyl trimethylammonium bromide or chloride, etc., a nonionic surfactant, or mixtures thereof; and (C) a di-long-chain imidazoline ester compound in place of some of the DEQA. The additional di-long-chain imidazoline ester compound, as well as providing additional softening and, especially, antistatic benefits, also acts as a reservoir of additional positive charge, so that any anionic surfactant which is carried over into the rinse solution from a conventional washing process is effectively neutralized.

5. Optional, but Highly Preferred, Soil Release Agent

Optionally, the compositions herein contain from 0% to about 10%, preferably from about 0.1% to about 5%, more preferably from about 0.1% to about 2%, of a soil release agent. Preferably, such a soil release agent is a polymer. Polymeric soil release agents useful in the present invention include copolymeric blocks of terephthalate and polyethylene oxide or polypropylene oxide, and the like. These agents give additional stability to the concentrated aqueous, liquid compositions. Therefore, their presence in such liquid compositions, even at levels which do not provide soil release benefits, is preferred.

A preferred soil release agent is a copolymer having blocks of terephthalate and polyethylene oxide. More specifically, these polymers are comprised of repeating units of ethylene and/or propylene terephthalate and polyethylene oxide terephthalate at a molar ratio of ethylene terephthalate units to polyethylene oxide terephthalate units of from about 25:75 to about 35:65, said polyethylene oxide terephthalate containing polyethylene oxide blocks having molecular weights of from about 300 to about 2000. The molecular weight of this polymeric soil release agent is in the range of from about 5,000 to about 55,000.

Another preferred polymeric soil release agent is a crystallizable polyester with repeat units of ethylene terephthalate units containing from about 10% to about 15% by weight of ethylene terephthalate units together with from about 10% to about 50% by weight of polyoxyethylene terephthalate units, derived from a polyoxyethylene glycol of average molecular weight of from about 300 to about 6,000, and the molar ratio of ethylene terephthalate units to polyoxyethylene terephthalate units in the crystallizable polymeric compound is between 2:1 and 6: 1. Examples of this polymer include the commercially available materials Zelcon® 4780 (from DuPont) and Milease® T (from ICI).

Highly preferred soil release agents are polymers of the generic formula:

$$X—(OCH_2CH_2)_n—(O—C(O)—R^1—C(O)—O—R^2)_u—(O—C(O)—R^1—C(O)—O)—(CH_2CH_2O)_n—X \quad \text{(b 1)}$$

in which X can be any suitable capping group, with each X being selected from the group consisting of H, and alkyl or acyl groups containing from about 1 to about 4 carbon atoms, preferably methyl, n is selected for water solubility and generally is from about 6 to about 113, preferably from about 20 to about 50, and u is critical to formulation in a liquid composition having a relatively high ionic strength. There should be very little material in which u is greater than 10. Furthermore, there should be at least 20%, preferably at least 40%, of material in which u ranges from about 3 to about 5.

The $R^1$ moieties are essentially 1,4-phenylene moieties. As used herein, the term "the $R^1$ moieties are essentially 1,4-phenylene moieties" refers to compounds where the $R^1$ moieties consist entirely of 1,4-phenylene moieties, or are partially substituted with other arylene or alkarylene moieties, alkylene moieties, alkenylene moieties, or mixtures thereof. Arylene and alkarylene moieties which can be partially substituted for 1,4-phenylene include 1,3-phenylene, 1,2-phenylene, 1,8-naphthylene, 1,4-naphthylene, 2,2-biphenylene, 4,4-biphenylene and mixtures thereof. Alkylene and alkenylene moieties which can be partially substituted include ethylene, 1,2-propylene, 1,4-butylene, 1,5-pentylene, 1,6-hexamethylene, 1,7-heptamethylene, 1,8-octamethylene, 1,4-cyclohexylene, and mixtures thereof.

For the $R^1$ moieties, the degree of partial substitution with moieties other than 1,4-phenylene should be such that the soil release properties of the compound are not adversely affected to any great extent. Generally, the degree of partial substitution which can be tolerated will depend upon the backbone length of the compound, i.e., longer backbones can have greater partial substitution for 1,4-phenylene moieties. Usually, compounds where the $R^1$ comprise from about 50% to about 100% 1,4-phenylene moieties (from 0 to about 50% moieties other than 1,4-phenylene) have adequate soil release activity. For example, polyesters made according to the present invention with a 40:60 mole ratio of isophthalic (1,3-phenylene) to terephthalic (1,4-phenylene) acid have adequate soil release activity. However, because most polyesters used in fiber making comprise ethylene terephthalate units, it is usually desirable to minimize the degree of partial substitution with moieties other than 1,4-phenylene for best soil release activity. Preferably, the $R^1$ moieties consist entirely of (i.e., comprise 100%) 1,4-phenylene moieties, i.e., each $R^1$ moiety is 1,4-phenylene.

For the $R^2$ moieties, suitable ethylene or substituted ethylene moieties include ethylene, 1,2-propylene, 1,2-butylene, 1,2-hexylene, 3-methoxy-1,2-propylene and mixtures thereof. Preferably, the $R^2$ moieties are essentially ethylene moieties, 1,2-propylene moieties or mixture thereof. Inclusion of a greater percentage of ethylene moieties tends to improve the soil release activity of compounds. Surprisingly, inclusion of a greater percentage of 1,2-propylene moieties tends to improve the water solubility of the compounds.

Therefore, the use of 1,2-propylene moieties or a similar branched equivalent is desirable for incorporation of any substantial part of the soil release component in the liquid fabric softener compositions. Preferably, from about 75% to about 100%, more preferably from about 90% to about 100%, of the $R^2$ moieties are 1,2-propylene moieties.

The value for each n is at least about 6, and preferably is at least about 10. The value for each n usually ranges from about 12 to about 113. Typically, the value for each n is in the range of from about 12 to about 43.

A more complete disclosure of these highly preferred soil release agents is contained in European Patent Application 185,427, Gosselink, published Jun. 25, 1986, incorporated herein by reference.

6. Cellulase

The optional cellulase usable in the compositions herein can be any bacterial or fungal cellulase. Suitable cellulases are disclosed, for example, in GB-A-2 075 028, GB-A-2 095 275 and DE—OS-24 47 832, all incorporated herein by reference in their entirety.

Examples of such cellulases are cellulase produced by a strain of Humicola insolens (Humicola grisea var. thermoidea), particularly by the Humicola strain DSM 1800, and cellulase 212-producing fungus belonging to the genus Aeromonas, and cellulase extracted from the hepatopancreas of a marine mullosc (Dolabella Auricula Solander).

The cellulase added to the composition of the invention can be in the form of a non-dusting granulate, e.g. "marumes" or "prills", or in the form of a liquid, e.g., one in which the cellulase is provided as a cellulase concentrate suspended in e.g. a nonionic surfactant or dissolved in an aqueous medium.

Preferred cellulases for use herein are characterized in that they provide at least 10% removal of immobilized radioactive labeled carboxymethyl-cellulose according to the $C_1{}^4$CMC-method described in EPA 350,098 (incorporated herein by reference in its entirety) at $25\times10^{-6}$% by weight of cellulase protein in the laundry test solution.

Most preferred cellulases are those as described in International Patent Application WO 91/17243, incorporated herein by reference in its entirety. For example, a cellulase preparation useful in the compositions of the invention can consist essentially of a homogeneous endoglucanase component, which is immunoreactive with an antibody raised against a highly purified 43 kD cellulase derived from *Humicola insolens,* DSM 1800, or which is homologous to said 43 kD endoglucanase.

The cellulases herein should be used in the liquid fabric-conditioning compositions of the present invention at a level equivalent to an activity from about 1 to about 125 CEVU/gram of composition (CEVU=Cellulase Equivalent Viscosity Unit, as described, for example, in WO 91/13136, incorporated herein by reference in its entirety), and preferably an activity of from about 5 to about 100. The granular solid compositions herein typically contain a level of cellulase equivalent to an activity from about 1 to about 250 CEVU/gram of composition, preferably an activity of from about 10 to about 150.

7. Optional Bacteriocides

Examples of bacteriocides used in the compositions of this invention are glutaraldehyde, formaldehyde, 2-bromo-2-nitropropane-1,3-diol sold by Inolex Chemicals under the trade name Bronopol®, and a mixture of 5-chloro-2-methyl-4-isothiazolin-3-one and 2-methyl-4-isothiazoline-3-one sold by Rohm and Haas Company under the trade name Kathon® CG/ICP. Typical levels of bacteriocides used in the present compositions are from about 1 to about 1,000 ppm by weight of the composition.

8. Other Optional Ingredients

Inorganic viscosity control agents such as water-soluble, ionizable salts can also optionally be incorporated into the compositions of the present invention. A wide variety of ionizable salts can be used. Examples of suitable salts are the halides of the Group IA and IIA metals of the Periodic Table of the Elements, e.g., calcium chloride, magnesium chloride, sodium chloride, potassium bromide, and lithium chloride. The ionizable salts are particularly useful during the process of mixing the ingredients to make the compositions herein, and later to obtain the desired viscosity. The amount of ionizable salts used depends on the amount of active ingredients used in the compositions and can be adjusted according to the desires of the formulator. Typical levels of salts used to control the composition viscosity are from about 20 to about 10,000 parts per million (ppm), preferably from about 20 to about 4,000 ppm, by weight of the composition.

Alkylene polyammonium salts can be incorporated into the composition to give viscosity control in addition to or in place of the water-soluble, ionizable salts above. In addition, these agents can act as scavengers, forming ion pairs with anionic detergent carried over from the main wash, in the rinse, and on the fabrics, and can improve softness performance. These agents can stabilize the viscosity over a broader range of temperature, especially at low temperatures, compared to the inorganic electrolytes.

Specific examples of alkylene polyammonium salts include L-lysine monohydrochloride and 1,5-diammonium 2-methyl pentane dihydrochloride.

The present invention can include other optional components conventionally used in textile treatment compositions, for example, dyes, colorants, perfumes, preservatives, optical brighteners, opacifiers, fabric conditioning agents, surfactants, stabilizers such as guar gum and polyethylene glycol, anti-shrinkage agents, anti-wrinkle agents, fabric crisping agents, spotting agents, germicides, fungicides, antioxidants such as butylated hydroxy toluene, anti-corrosion agents, and the like.

In the method aspect of this invention, fabrics or fibers are contacted with an effective amount, generally from about 10 ml to about 150 ml (per 3.5 kg of fiber or fabric being treated) of the softener actives (including DEQA) herein in an aqueous bath. Of course, the amount used is based upon the judgment of the user, depending on concentration of the composition, fiber or fabric type, degree of softness desired, and the like. Preferably, the rinse bath contains from about 10 to about 2,500 ppm, preferably from about 30 to about 2000 ppm, of the DEQA fabric softening compounds herein.

(F) Solid Particulate Compositions

As discussed hereinbefore, the invention also comprises solid particulate composition comprising:

(A) from about 50% to about 95%, preferably from about 60% to about 90%, of biodegradable cationic softening compound, preferably quaternary ammonium fabric softening compound;

(B) from about 0.01% to about 15%, preferably from about 0.05% to about 5%, of an enduring perfume composition;

(C) optionally, from 0% to about 30%, preferably from about 3% to about 15%, of dispersibility modifier; and (D) from 0% to about 10% of a pH modifier.

1. Optional pH Modifier

Since the biodegradable cationic diester quaternary ammonium fabric softener actives are somewhat labile to hydrolysis, it is preferable to include optional pH modifiers in the solid particulate composition to which water is to be added, to form stable dilute or concentrated liquid softener compositions. Said stable liquid compositions should have a pH (neat) of from about 2 to about 5, preferably from about 2 to about 4.5, more preferably from about 2 to about 4.

The pH can be adjusted by incorporating a solid, water soluble Bronsted acid. Examples of suitable Bronsted acids include inorganic mineral acids, such as boric acid, sodium bisulfate, potassium bisulfate, sodium phosphate monobasic, potassium phosphate monobasic, and mixtures thereof; organic acids, such as citric acid, fumaric acid, maleic acid, malic acid, tannic acid, gluconic acid, glutamic acid, tartaric acid, glycolic acid, chloroacetic acid, phenoxyacetic acid, 1,2,3,4-butane tetracarboxylic acid, benzene sulfonic acid, benzene phosphonic acid, ortho-toluene sulfonic acid, para-toluene sulfonic acid, phenol sulfonic acid, naphthalene sulfonic acid, oxalic acid, 1,2,4,5-pyromellitic acid, 1,2,4-trimellitic acid, adipic acid, benzoic acid, phenylacetic acid, salicylic acid, succinic acid, and mixtures thereof; and mixtures of mineral inorganic acids and organic acids. Preferred pH modifiers are citric acid, gluconic acid, tartaric acid, 1,2,3,4-butane tetracarboxylic acid, malic acid, and mixtures thereof.

Optionally, materials that can form solid clathrates such as cyclodextrins and/or zeolites, etc., can be used as adjuvants in the solid particulate composition as host carriers of concentrated liquid acids and/or anhydrides, such as acetic acid, HCl, sulfuric acid, phosphoric acid, nitric acid, carbonic acid, etc. An example of such solid clatherates is carbon dioxide adsorbed in zeolite A, as disclosed in U.S. Pat. No. 3,888,998, Whyte and Samps, issued Jun. 10, 1975 and U.S. Pat. No. 4,007,134, Liepe and Japikse, issued Feb. 8, 1977, both of said patents being incorporated herein by reference. Examples of inclusion complexes of phosphoric acid, sulfuric acid, and nitric acid, and process for their preparation are disclosed in U.S. Pat. No. 4,365,061, issued Dec. 21, 1982 to Szejtli et al., said patent being incorporated herein by reference.

When used, the pH modifier is typically used at a level of from about 0.01% to about 10%, preferably from about 0.1% to about 5%, by weight of the composition.

2. Preparation of Solid Particulate Granular Fabric Softener

The granules can be formed by preparing a melt, solidifying it by cooling, and then grinding and sieving to the desired size. In a three-component mixture, e.g., nonionic surfactant, single-long-chain cationic, and DEQA, it is more preferred, when forming the granules, to pre-mix the nonionic surfactant and the more soluble single-long-chain alkyl cationic compound before mixing in a melt of the diester quaternary ammonium cationic compound.

It is highly preferred that the primary particles of the granules have a diameter of from about 50 to about 1,000, preferably from about 50 to about 400, more preferably from about 50 to about 200, microns. The granules can comprise smaller and larger particles, but preferably from about 85% to about 95%, more preferably from about 95% to about 100%, are within the indicated ranges. Smaller and larger particles do not provide optimum emulsions/dispersions when added to water. Other methods of preparing the primary particles can be used including spray cooling of the melt. The primary particles can be agglomerated to form a dust-free, non-tacky, free-flowing powder. The agglomeration can take place in a conventional agglomeration unit (i.e., Zig-Zag Blender, Lodige) by means of a water-soluble binder. Examples of water-soluble binders useful in the above agglomeration process include glycerol, polyethylene glycols, polymers such as PVA, polyacrylates, and natural polymers such as sugars.

The flowability of the granules can be improved by treating the surface of the granules with flow improvers such as clay, silica or zeolite particles, water-soluble inorganic salts, starch, etc.

3. Method of Use

Water can be added to the particulate, solid, granular compositions to form dilute or concentrated liquid softener compositions for later addition to the rinse cycle of the laundry process with a concentration of said biodegradable cationic softening compound of from about 0.5% to about 50%, preferably from about 1% to about 35%, more preferably from about 4% to about 32%,. The particulate, rinse-added solid composition (1) can also be used directly in the rinse bath to provide adequate usage concentration (e.g., from about 10 to about 1,000 ppm, preferably from about 50 to about 500 ppm, of total softener active ingredient). The liquid compositions can be added to the rinse to provide the same usage concentrations.

The water temperature for preparation should be from about 20° C. to about 90° C., preferably from about 25° C. to about 80° C. Single-long-chain alkyl cationic surfactants as the viscosity/dispersibility modifier at a level of from 0% to about 15%, preferably from about 3% to about 15%, more preferably from about 5% to about 15%, by weight of the composition, are preferred for the solid composition. Nonionic surfactants at a level of from about 5% to about 20%, preferably from about 8% to about 15%, as well as mixtures of these agents can also serve effectively as the viscosity/dispersibility modifier.

The emulsified/dispersed particles, formed when the said granules are added to water to form aqueous concentrates, typically have an average particle size of less than about 10 microns, preferably less than about 2 microns, and more preferably from about 0.2 to about 2 microns, in order that effective deposition onto fabrics is achieved. The term "average particle size," in the context of this specification, means a number average particle size, i.e., more than 50% of the particles have a diameter less than the specified size.

Particle size for the emulsified/dispersed particles is determined using, e.g., a Malvern particle size analyzer.

Depending upon the particular selection of nonionic and cationic surfactant, it can be desirable in certain cases, when using the solids to prepare the liquid, to employ an efficient means for dispersing and emulsifying the particles (e.g., blender).

Solid particulate compositions used to make liquid compositions can, optionally, contain electrolytes, perfume, antifoam agents, flow aids (e.g., silica), dye, preservatives, and/or other optional ingredients described hereinbefore.

The benefits of adding water to the particulate solid composition to form aqueous compositions to be added later to the rinse bath include the ability to transport less weight thereby making shipping more economical, and the ability to form liquid compositions similar to those that are normally sold to consumers, e.g., those that are described herein, with lower energy input (i.e., less shear and/or lower temperature). Furthermore, the particulate granular solid fabric softener compositions, when sold directly to the consumers, have less packaging requirements and smaller, more disposable containers. The consumers will then add the compositions to available, more permanent, containers, and add water to pre-dilute the compositions, which are then ready for use in the rinse bath, just like the liquid compositions herein. The liquid form is easier to handle, since it simplifies measuring and dispensing.

In the specification and examples herein, all percentages, ratios and parts are by weight unless otherwise specified and all numerical limits are normal approximations.

The following examples illustrate the esters and compositions of this invention, but are not intended to be limiting thereof.

Example 1

Dinonadyl maleate

Nonadyl alcohol in the amount of 18.00 g (0.105 mol), maleic anhydride in the amount of 3.47 g (0.035 mol), and p-toluenesulfonic acid in the amount of 69.0 mg (0.363 mmol) were combined with 50 mL of toluene in a flask fitted with a condenser, argon inlet and Dean-Stark trap. The mixture was heated to reflux for 18 h at which time the theoretical amount of water was collected. The product mixture was poured into separatory funnel and washed with saturated $NaHCO_3$ solution (3×50 mL), brine (50 mL), water (50 mL), dried over $MgSO_4$, filtered and concentrated to give a light yellow oil. The product mixture was further concentrated by Kugelrohr distillation at 85° C. (0.1 mm Hg) to give a viscous oil. Purification of the product by column chromatography on silica gel eluting with a 10% solution of ethyl acetate in petroleum ether provided a colorless oil. Purity of the product was determined by thin layer chromatography and the structure confirmed by $^1H$ and $^{13}C$ NMR.

Example 2

Di(β-citronellyl) maleate

β-Citronellol in the amount of 140.00 g (0.851 mol), maleic anhydride in the amount of 28.10 g (0.284 mol), and p-toluenesulfonic acid in the amount of 0.54 g (2.84 mmol) were combined with 380 mL of toluene in a flask fitted with a condenser, argon inlet and Dean-Stark trap. The mixture was heated to reflux for 27 h at which time the theoretical amount of water was collected. The product mixture was poured into separatory funnel and washed with saturated $NaHCO_3$ solution (3×75 mL), brine (75 mL); water (75 mL), dried over $MgSO_4$, filtered and concentrated to give a light yellow oil. The product mixture was further concentrated by Kugelrohr distillation at 90°–95° C. (0.1 mm Hg) to give a viscous oil. Purification of the product by column chromatography on silica gel eluting with a 10% solution of ethyl acetate in petroleum ether provided a colorless oil. Purity of the product was determined by thin layer chromatography and the structure confirmed by $^1H$ and $^{13}C$ NMR.

Example 3

Di(cyclohexylethyl) maleate

Cyclohexylethyl alcohol in the amount of 17.15 g (0.134 mol), maleic anhydride in the amount of 4.42 g (0.045 mol) and p-toluenesulfonic acid in the amount of 0.09 g (0.40 mmol) were combined with 80 mL of toluene in a flask fitted with a condenser, argon inlet and Dean-Stark trap. The mixture was heated to reflux for 18 h at which time the theoretical amount of water was collected. The product mixture was poured into separatory funnel and washed with saturated $NaHCO_3$ solution (3×80 mL), brine (80 mL), water (80 mL), dried over $MgSO_4$, filtered and concentrated to give an oil. The product mixture was further concentrated by Kugelrohr distillation at 85° C. (0.1 mm Hg) to give a viscous oil. Purity of the product was determined by thin layer chromatography and the structure confirmed by $^1H$ and $^{13}C$ NMR.

Example 4

Diphenoxanyl maleate

Phenoxanol (phenylhexanol) in the amount of 48.95 g (0.274 mol) and maleic anhydride in the amount of 9.06 g (0.092 mol) were combined with 125 mL of toluene in a flask fitted with a condenser, argon inlet and Dean-Stark trap. The mixture was heated to reflux for 24 h at which time the theoretical amount of water was collected. The cooled mixture was concentrated first by rotary evaporation to remove excess toluene and then by Kugelrohr distillation at 105° C. to remove excess alcohol. Purification of the product by column chromatography on silica gel eluting with a 10% solution of ethyl acetate in petroleum ether provided a colorless oil. Purity of the product was determined by thin layer chromatography and the structure confirmed by $^1H$ and $^{13}C$ NMR.

Example 5

Difloralyl succinate

Floralol in the amount of 17.41 g (0.124 mol), succinic anhydride in the amount of 4.27 g (0.041 mol) and p-toluenesulfonic acid in the amount of 0.10 g (0.53 mmol) were combined with 80 mL of toluene in a flask fitted with a condenser, argon inlet and Dean-Stark trap. The mixture was heated to reflux for 18 h at which time the theoretical amount of water was collected. The product mixture was poured into separatory funnel and washed with saturated $NaHCO_3$ solution (3×80 mL), brine (80 mL), water (80 mL), dried over $MgSO_4$, filtered and concentrated to give an oil. The product mixture was further concentrated by Kugelrohr distillation at 80° C. (0.1 mm Hg) to give a viscous oil. Purity of the product was determined by thin layer chromatography and the structure confirmed by $^1H$ and $^{13}C$ NMR.

Example 6

Di(3,7-dimethyl-1-octanyl)succinate

The method of Example 5 is repeated with the substitution of 3,7-dimethyl-1-octanol for floralol.

Example 7

Di(phenylethyl)adipate

The method of Example 5 is repeated with the substitution of phenylethanol for floralol and adipic anhydride for succinic anhydride.

Example 8

Liquid fabric softener compositions according to the present invention are formulated as follows:

| Formulation Example: Ingredient | A Wt. % | B Wt. % | C Wt. % | D Wt. % | E Wt. % |
|---|---|---|---|---|---|
| DEQA (1) | 26.0 | 24.0 | 25.0 | 24.0 | 25.0 |
| Ethanol | 4.2 | 3.9 | 4.0 | 3.9 | 4.0 |
| HCl | 0.01 | 0.01 | 0.01 | 0.01 | 0.01 |
| $CaCl_2$ | 0.46 | 0.46 | 0.46 | 0.46 | 0.46 |
| Silicone Antifoam (2) | 0.15 | 0.15 | 0.15 | 0.15 | 0.15 |
| Preservative (3) | 0.0003 | 0.0003 | 0.0003 | 0.0003 | 0.0003 |
| Perfume | 1.20 | 1.00 | — | 1.35 | 1.10 |
| Dinonadyl maleate (4) | 0.50 | — | — | — | — |
| Diphenoxanyl maleate (5) | — | 0.65 | — | — | — |
| Di(β-citronellyl) maleate (6) | — | — | 1.00 | — | — |
| Difloralyl succinate (7) | — | — | — | 0.75 | — |
| Di(cyclohexylethyl) maleate (8) | — | — | — | — | 0.25 |
| Water | 67.47 | 69.83 | 69.38 | 69.38 | 69.03 |

(1) Di-(soft-tallowyloxyethyl) dimethyl ammonium chloride
(2) DC-2310, sold by Dow-Coming
(3) Kathon CG, sold by Rohm & Haas
(4) 1,4-Butendioic acid, 1,5,7-trimethyl-1-ocatanyl ester
(5) 1,4-Butendioic acid, 3-methyl-5-phenyl-1-pentanyl ester
(6) 1,4-Butendioic acid, 3,7-dimethyl-1-oct-6-enyl ester
(7) 1,4-Butandioic acid, (4,6-dimethyl-cyclohex-3-ene)methyl ester
(8) 1,4-Butendioic acid, 2-cyclohexyl-ethyl ester Process Examples A is made in the following manner: A blend of 260 g DEQA(1) and 42 g ethanol are melted at about 70° C. A 25% aqueous solution of HCl in the amount of 40 g is added to about 675 g of deionized water also at 70° C. containing the antifoam. The DEQA/alcohol blend is added to the water/HCl over a period of about five minutes with very vigorous agitation (IKA Padel Mixer, model RW 20 DZM at 1500 rpm). A 25% aqueous solution of $CaCl_2$ in the amount of 13.8 g is added to the dispersion dropwise over 1 minute, followed by milling with an IKA Ultra Turrax T-50 high shear mill for 5 minutes. The dispersion is then cooled to room temperature by passing it through a plate and frame heat exchanger. Following cooldown, perfume in the amount of 12.0 g and dinonadyl maleate in the amount of 5.0 g are are belended into the dispersion with moderate agitation. Finally, another 4.6 g of 25% $CaCl_2$ is mixed into the dispersion.

Examples B–E are made in a like manner, varying the amounts and perfume esters as indicated in the table.

| Formulation Example: Ingredient | F Wt. % | G Wt. % |
|---|---|---|
| DEQA (1) | 19.2 | 18.2 |
| Isopropyl alcohol | 3.1 | 2.9 |
| Tallow Alcohol Ethoxylate -25 | — | 1.20 |
| Poly(glycerol monostearate) | — | 2.40 |
| HCl | 0.02 | 0.08 |
| $CaCl_2$ | 0.12 | 0.18 |
| Silicone Antifoam | 0.02 | 0.02 |
| Soil Release Polymer | 0.19 | 0.19 |
| Poly(ethyleneglycol) 4000 MW | 0.60 | 0.60 |
| Perfume | 0.70 | 0.70 |
| Dinonadyl maleate (4) | 0.40 | — |
| Diphenoxanyl maleate (5) | — | 0.50 |
| Water | 75.65 | 73.03 |

(1) Di-(soft-tallowyloxyethyl) dimethyl ammonium chloride
(4) 1,4-Butendioic acid, 1,5,7-trimethyl-1-ocatanyl ester
(5) 1,4-Butendioic acid, 3-methyl-5-phenyl-1-pentanyl ester

What is claimed is:

1. A rinse-added rinse cycle fabric softening composition selected from the group consisting of:

I. a solid particulate composition comprising:

(A) from about 50% to about 95% of biodegradable cationic quaternary ammonium fabric softening compound;

(B) from 0.01% to about 15% by weight of the composition, of a diester having the formula $R_1R'R_2$ wherein R' is a residue of an acid forming diester selected from the group consisting of succinic acid or maleic acid; and wherein $R_1$ and $R_2$ independently represent a residue of an alcohol forming diester selected from the group consisting of phenoxanol, floralol, B-citronellol, nonadyl, cyclohexyl ethanol, phenyl ethanol, isoborneol, fenchol, isocyclogeraniol, 2-phenyl-1-propanol, 3,7-dimethyl-1-octanol and mixtures thereof;

(C) optionally, from about 0 to about 30% of dipsersibility modifier; and (D) optionally, from about 0% to about 15% of pH modifier; and II. a liquid composition comprising:

(A) from about 0.5% to about 80% of biodegrable cationic quaternary ammonium fabric softening compound;

(B) from 0.01% to about 15% by weight of the composition, of a diester having the formula $R_1R'R_2$ wherein R' is a residue of an acid forming diester selected from the group consisting of succinic acid or maleic acid; and wherein $R_1$ and $R_2$ independently represent a residue of an alcohol forming diester selected from the group consisting of phenoxanol, floralol, B-citronellol, nonadyl, cyclohexyl ethanol, phenyl ethanol, isoborneol, fenchol, isocyclogeraniol, 2-phenyl-1-propanol, 3,7 -dimethyl-1-octanol and mixtures thereof;

(C) optionally, from about 0 to about 30% of dipsersibility modifier; and (D) the balance comprising liquid carrier selected from the group consisting of water, $C_{1-4}$ monohydric alcohol, $C_{2-6}$ polyhydric alcohol, propylene carbonate, liquid polyethylene glycols and mixtures thereof.

2. The composition of claim 1 wherein component (A) has the formula:

$$(R)_{4-m}—^{+}N—((CH_2)_n—Y—R^2)_mX^-$$

wherein: each Y is —O—(O)C—, or —C(O)—O—; m is 2 or 3; n is 1 to 4; each R is a $C_1$–$C_6$ alkyl group, hydroxyalkyl group, benzyl group, or mixtures thereof; each $R^2$ is a $C_{12}$–$C_{22}$ hydrocarbyl or substituted hydrocarbyl substituent; and $X^-$ is any softener-compatible anion.

3. The composition of claim 2 wherein component (A) is derived from $C_{12}$–$C_{22}$ fatty acyl groups having an Iodine Value of from greater than about 5 to less than about 100, a cis/trans isomer weight ratio of greater than about 30/70 when the Iodine Value is less than about 25, the level of unsaturation of the fatty acyl groups being less than about 65% by weight.

4. The composition of claim 3 wherein said ester component (B) is selected from a group consisting of di(β-citronellyl) maleate, dinonadyl maleate, diphenoxanyl maleate, di(3,7-dimethyl-1-octanyl) succinate, di(cyclohexylethyl) maleate, difloralyl succinate, and di(phenylethyl) adipate.

5. The composition of claim 4 wherein the level of said component (B) is from about 0.1% to about 6%.

6. The composition of claim 5 wherein the level of said component (B) is from about 0.15% to about 4%.

7. The composition of claim 1 wherein said dispersibility modifier is selected from the group consisting of: single-long-chain—$C_{10}$–$C_{22}$ alkyl, cationic surfactant; nonionic surfactant with at least 8 ethoxy moieties; amine oxide surfactant; and mixtures thereof.

8. The composition according to claim 7 wherein the dispersibility modifier is a single-long-chain-alkyl cationic surfactant at an effective level of up to about 15% of the composition.

9. The composition according to claim 8 wherein the dispersibility modifier is a quaternary ammonium salt of the general formula:

$$(R^2N^+R_3)X^-$$

wherein the $R^2$ group is a $C_{10}$–$C_{22}$ hydrocarbon group, or the corresponding ester linkage interrupted group with a short alkylene ($C_1$–$C_4$) group between the ester linkage and the N, and having a similar hydrocarbon group, each R is a $C_1$–$C_4$ alkyl or substituted alkyl, or hydrogen; and the counterion $X^-$ is a softener compatible anion.

10. The composition according to claim 9 wherein the dispersibility modifier is $C_{12}$–$C_{14}$ choline ester.

11. The composition according to claim 7 wherein the dispersibility modifier is nonionic surfactant at an effective level of up to about 20% of the composition.

12. The composition according to claim 11 wherein the dispersibility modifier is $C_{10}$–$C_{14}$ alcohol with poly(10–18)ethoxylate.

13. The composition according to claim 7 wherein the dispersibility modifier is amine oxide with one alkyl, or hydroxyalkyl, moiety of about 8 to about 22 carbon atoms and two alkyl moieties selected from the group consisting of alkyl groups and hydroxyalkyl groups containing from one to about three carbon atoms.

14. The composition of claim 1 wherein the composition is a solid particulate composition comprising:

(A) from about 60% to about 90% of biodegradable cationic quaternary ammonium fabric softening compound;

(B) from about 0.05% to about 8% by weight of the composition, of ester of non-allylic alcohol perfume selected from the group consisting of di(β-citronellyl) maleate, dinonadyl maleate, diphenoxanyl maleate, di(3,7-dimethyl-1-octanyl) succinate, di(cyclohexylethyl) maleate, difloralyl succinate, and combinations thereof and (C) from 3% to about 15% of dispersibility modifier; and (D) optionally, from 0% to about 10% of pH modifier.

15. The composition of claim 1 wherein the composition is a liquid composition comprising:

(A) from about 1% to about 35% of biodegradable quaternary ammonium fabric softening compound;

(B) from about 0.05% to about 6% by weight of the composition, of ester of non-allylic alcohol perfume selected from the group consisting of di(β-citronellyl) maleate, dinonadyl maleate, diphenoxanyl maleate, di(3,7-dimethyl-1-octanyl) succinate, di(cyclohexylethyl) maleate, difloralyl succinate, and combinations thereof and (C) from about 0.5% to about 10% of dispersibility modifier wherein the dispersibility modifier affects the composition's viscosity, dispersibility in a laundry process rinse cycle, or both; and (D) the balance comprising liquid carrier selected from the group consisting of water; $C_1$–$C_4$ monohydric alcohols; $C_2$–$C_6$ polyhydric alcohols; propylene carbonate; liquid polyalkylene glycols; and mixtures thereof.

16. A process of treating textiles in a rinse cycle of a washing machine comprising:

contacting textiles in a washing machine with a fabric softening effective amount of a biodegradable cationic quaternary ammonium fabric softening compound and from 0.01% to about 15% by weight of the composition a diester having the formula $R_1R'R_2$ wherein R' is a residue of a dicarboxylic acid forming diester selected from the group consisting of succinic acid or maleic acid; and wherein $R_1$ and $R_2$ independently represent a residue of an alcohol forming diester selected from the group consisting of phenoxanol, floralol, B-citronellol, nonadyl, cyclohexyl ethanol, phenyl ethanol, isoborneol, fenchol, isocyclogeraniol, 2-phenyl-1-propanol, 3,7-dimethyl-1-octanol and mixtures thereof.

* * * * *